US007907155B2

(12) United States Patent
Shiomi

(10) Patent No.: US 7,907,155 B2
(45) Date of Patent: Mar. 15, 2011

(54) DISPLAY DEVICE AND DISPLAYING METHOD

(75) Inventor: Makoto Shiomi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 851 days.

(21) Appl. No.: 11/884,342

(22) PCT Filed: Feb. 21, 2006

(86) PCT No.: PCT/JP2006/303009

§ 371 (c)(1),
(2), (4) Date: Aug. 15, 2007

(87) PCT Pub. No.: WO2006/092977

PCT Pub. Date: Sep. 8, 2006

(65) Prior Publication Data

US 2010/0085492 A1 Apr. 8, 2010

(30) Foreign Application Priority Data

Mar. 4, 2005 (JP) ..... 2005-060928

(51) Int. Cl.
*G09G 5/10* (2006.01)
*G09G 5/00* (2006.01)

(52) U.S. Cl. ..... 345/690; 345/89; 345/204

(58) Field of Classification Search ..... 345/208, 345/209, 690, 204, 89, 98, 99, 100, 102
See application file for complete search history.

(56) References Cited

U.S. PATENT DOCUMENTS 6,693,618 B2 * 2/2004 Son et al. ..... 345/99
6,771,243 B2 * 8/2004 Hirohata ..... 345/89
6,970,148 B2 * 11/2005 Itoh et al. ..... 345/63
7,173,595 B2 * 2/2007 Tanaka et al. ..... 345/98
2002/0003520 A1 1/2002 Aoki
2003/0011614 A1 1/2003 Itoh et al.
2004/0155847 A1 8/2004 Taoka et al.

(Continued)

FOREIGN PATENT DOCUMENTS

JP 2003-271110 9/2003

(Continued)

OTHER PUBLICATIONS

International Search Report PCT/ISA/210.

(Continued)

*Primary Examiner* — Duc Q Dinh
(74) *Attorney, Agent, or Firm* — Harness, Dickey & Pierce, P.L.C.

(57) ABSTRACT

The present invention relates to a hold type display device.

One frame period that is a period when an image of one screen is displayed is divided into a dark display period when a relatively dark image is displayed and a bright display period when a relatively bright image is displayed. In the dark display period, each of scanning signal lines (GL1, GL2, GL3, etc.) is driven consecutively two times each during a period corresponding to one third of a conventional one horizontal scanning period. Also, in the dark display period, each two lines of the scanning signal lines (GL1, GL2, GL3, etc.) is driven at the same time. A gradation is calculated for generating a video signal such that, at two pixel formation portions arranged at intersections of these two scanning signal lines driven at the same time and a video signal line, a luminance averaged from luminances originally to be appeared at the two pixel formation portions appears.

8 Claims, 15 Drawing Sheets

U.S. PATENT DOCUMENTS

| | | | | |
|---|---|---|---|---|
| 2005/0162360 | A1* | 7/2005 | Ishihara et al. | 345/89 |
| 2005/0184944 | A1* | 8/2005 | Miyata et al. | 345/89 |
| 2005/0253785 | A1 | 11/2005 | Miyasaka et al. | |
| 2006/0022964 | A1* | 2/2006 | Kim et al. | 345/204 |

FOREIGN PATENT DOCUMENTS

| | | |
|---|---|---|
| JP | 2004-212749 | 7/2004 |
| JP | 2004-233949 | 8/2004 |
| JP | 2004-240317 | 8/2004 |
| JP | 2005-173387 | 6/2005 |

OTHER PUBLICATIONS

Written Opinion PCT/ISA/237.

* cited by examiner

DARK DISPLAY PERIOD
BRIGHT DISPLAY PERIOD
1f
1/2 f
1/2 f

0% CASE

25% CASE

50% CASE

75% CASE

100% CASE

DISPLAY DEVICE AND DISPLAYING METHOD

TECHNICAL FIELD

The present invention relates to a hold type display device, and more specifically to a hold type display device which performs image display by dividing one frame period into a plurality of sub-frame periods and to a displaying method thereof.

BACKGROUND ART

Conventionally, impulse type display devices such as a CRT (Cathode Ray Tube), for example, and hold type display devices such as an LCD (Liquid Crystal Display), for example, are known as display devices. In the impulse type display device, focusing on an individual pixel, an on-period when an image is displayed and an off-period when an image is not displayed are repeated alternately. Even in a case where a motion picture is displayed, for example, human vision does not have an afterimage of a moving object, since an off-period is inserted when an image of one screen is rewritten. Therefore, a background and an object are clearly distinguished and a motion picture is viewed without any sense of discomfort. On the other hand, in the hold type display device, a luminance of an individual pixel is held during a whole frame period that is a rewrite period of an image of one screen. When a motion picture is displayed on this hold type display device, human vision has an afterimage of a moving object. Specifically, a moving object is viewed with an outline out of focus. Such a phenomenon is called such as a "motion blur" and considered to be caused by followability of human line of sight. Since the hold type display devices have such a motion blur for displaying a motion picture, conventionally, the impulse type display devices are generally employed for displays such as a TV which displays mainly motion pictures. Recently, however, displays such as a TV have been strongly required to be lighter or thinner, and hold type display devices which are easily made lighter or thinner have been increasingly employed rapidly for such displays.

Conventionally, the hold type display devices have also another problem that deterioration of image quality is caused by a low response speed of display elements. An overshoot drive is known for a drive method to suppress this image quality deterioration (e. g., Japanese Patent Application Laid Open No. 2004-233949). The overshoot drive is a drive method to provide a liquid crystal display panel, according to a combination of an input image signal of a previous frame and an input image signal of a current frame, with a higher drive voltage than a predetermined gradation voltage for the input image signal of the current frame or with a lower drive voltage than a predetermined gradation voltage for the input image signal of the current frame.

On the other hand, there is proposed an display device that performs image display by a pseudo impulse drive (hereinafter referred to as "pseudo-impulse drive") where a frame period is divided into a period when an image is displayed (hereinafter referred to as "display period") and a period when an image is not displayed (hereinafter referred to as "non-display period"), for suppressing the above mentioned motion blur (e.g., Japanese Patent Application Laid Open No. 2002-23707 and Japanese Patent Application Laid Open No. 2003-22061). FIG. 14 is a signal waveform diagram for explaining such a display device drive method. Here, a display device is assumed to have a plurality of (m) scanning signal lines GL1 to GLm (hereinafter also referred to as "the first row to m-th row scanning signal lines"). As shown in FIG. 14, when a pulse of a gate clock signal GCK is generated first after pulse generation of a gate start pulse signal GSP, a scanning signal supplied to the first row scanning signal line GL1 comes to exhibit a high level. A pulse width of the gate clock signal GCK corresponds to approximately a half of a conventional one horizontal scanning period, and, during a whole period corresponding to the pulse width, the scanning signal supplied to the first row scanning signal line GL1 is held at the high level. After that, according to pulse generation of the gate clock signal GCK, scanning signals supplied to scanning signal lines GL2, GL3, etc. below the first row, come to exhibit high levels sequentially and are held at the high levels during a whole period corresponding to approximately a half of the conventional one horizontal scanning period, respectively. After scanning signals supplied to all the scanning signal lines come to exhibit high levels in this manner each during a period corresponding to approximately a half of the conventional one horizontal scanning period, a pulse of the gate start pulse signal GSP is generated again. After that, according to pulse generation of the gate clock signal GCK, the scanning signals supplied to all the scanning signal lines again come to exhibit high levels sequentially and the high levels are held during a whole period corresponding to approximately a half of the conventional one horizontal scanning period. In this manner, one frame period (1f) is divided into two periods having the same length with each other (1f/2). For details, as shown in FIG. 15, one frame period is divided into two periods called sub-frames, and an image is displayed only in one sub-frame period (display period) and an image is not displayed in the other sub-frame period (non-display period). Thereby, a black image is inserted between a preceding image and a following image when an image of one screen is rewritten. As a result, human vision does not have an afterimage of a moving object and the motion blur is suppressed.

[Patent Document 1] Japanese Patent Application Laid Open No. 2004-233949

[Patent Document 2] Japanese Patent Application Laid Open No. 2002-23707

[Patent Document 3] Japanese Patent Application Laid Open No. 2003-22061

DISCLOSURE OF THE INVENTION

Problem to be Solved by the Invention

In a case where image display is performed by the above described pseudo-impulse drive, however, a length of the display period becomes shorter than in a conventional drive, since a length of one frame period is the same as that of the conventional one. In other words, a time for charging a pixel capacitance corresponding to each pixel becomes shorter than in the conventional one. In an example shown in FIGS. 14 and 15, one frame period is divided into two sub-frame periods having the same length with each other. Therefore, for a time to charge a pixel capacitance, only a time approximately a half of that of the conventional drive is secured. Thereby, there is a case a pixel capacitance is not charged sufficiently and a luminance originally to be displayed does not appear at each pixel. As a result, deterioration of image quality is caused when a motion picture is displayed. Although an overshoot drive as described hereinabove is proposed for suppressing image quality deterioration caused by a low response speed of display elements, determination of drive signal levels is also not easy.

Accordingly, an object of the present invention is to realize a hold type display device that can prevent efficiently image quality deterioration caused by insufficient charging of pixel capacitances, while suppressing the motion blur for displaying a motion picture.

Means for Solving the Problem

A first aspect of the present invention is a display device provided with: a plurality of video signal lines for transmitting a video signal based on an image to be displayed; a plurality of scanning signal lines intersecting with the plurality of video signal lines; a plurality of pixel formation portions arranged in a matrix respectively corresponding to intersections of the plurality of video signal lines and the plurality of scanning signal lines; and a display control circuit that outputs the video signal and a scanning-signal-line drive timing signal for driving the plurality of scanning signal lines: wherein a frame period, which is a period for displaying an image of one screen, is divided into one or more dark display periods when a relatively low luminance image is displayed and one or more bright display periods when a relatively high luminance image is displayed, and the image of one screen is displayed using the one or more dark display periods and the one or more bright display periods by displaying with luminances determined based on a gradation of the image of one screen during each of the one or more dark display periods and the one or more bright display periods; and wherein one dark display period is set to be a period shorter than one bright display period.

A second aspect of the present invention is a display device according to the first aspect of the present invention, wherein the display control circuit outputs the scanning-signal-line drive timing signal such that each two or more predetermined number of scanning signal lines of the plurality of scanning signal lines is driven at the same time during the dark display period.

A third aspect of the present invention is a display device according to the second aspect of the present invention, wherein the two or more predetermined number of scanning signal lines driven at the same time are a plurality of the scanning signal lines arranged consecutively in a direction where the plurality of video signal lines extend, and each scanning signal line is consecutively driven a plurality of times during the dark display period.

A fourth aspect of the present invention is a display device according to the second aspect of the present invention, wherein the two or more predetermined number of scanning signal lines driven at the same time are a plurality of scanning signal lines alternately selected from among the plurality of scanning signal lines, each scanning signal line is driven a plurality of times during the dark display period, and the display control circuit outputs the scanning-signal-line drive timing signal and the video signal such that a polarity of a video signal applied to each video signal line becomes the same in all the periods when each scanning signal line is driven the plurality of times.

A fifth aspect of the present invention is a display device according to the second aspect, wherein the display control circuit outputs the video signal such that, during a period when the two or more predetermined number of scanning signal lines are driven at the same time, a luminance of a combined pixel formation portion group, which is a plurality of pixel formation portions arranged corresponding to intersections of the two or more predetermined number of scanning signal lines and each of the video signal lines, becomes an average value of luminances to be displayed during the dark display period at a plurality of pixel formation portions included in the combined pixel formation portion group and to be determined based on the gradation of the image of one screen.

A sixth aspect of the present invention is a display device according to the fifth aspect, wherein the display control circuit includes a dark-display-period gradation calculation circuit for calculating a gradation of the combined pixel formation portion group during the dark display period, the dark-display-period gradation calculation circuit:

calculating an average value of luminances of a plurality of pixel formation portions included in the combined pixel formation portion group based on luminances to be displayed during the dark display period at each of the pixel formation portions and to be determined based on the gradation of the image of one screen; and calculating the gradation of the combined pixel formation portion group during the dark display period based on the average value.

A seventh aspect of the present invention is a display device according to the sixth aspect, wherein the dark-display-period gradation calculation circuit further includes a charge compensation circuit for performing a predetermined compensation so as to increase a charging rate in each pixel formation portion when calculating the gradation of the combined pixel formation portion group during the dark display period.

An eighth aspect of the present invention is a display device according to the second aspect, wherein the display control circuit outputs the video signal such that, during a period when the two or more predetermined number of scanning signal lines are driven at the same time, a luminance of a combined pixel formation portion group, which is a plurality of pixel formation portions arranged corresponding to intersections of the two or more predetermined number of scanning signal lines and each of the video signal lines, becomes a luminance to be displayed during the dark display period at a predetermined pixel formation portion among a plurality of pixel formation portions included in the combined pixel formation portion group and to be determined based on the gradation of the image of one screen.

A ninth aspect of the present invention is a display device according to the first aspect, wherein the one or more dark display periods precede in time the one or more bright display periods within the frame period.

A tenth aspect of the present invention is a displaying method for a display device, the display device including a plurality of video signal lines for transmitting a video signal based on an image to be displayed; a plurality of scanning signal lines that intersects with the plurality of video signal lines; and a plurality of pixel formation portions arranged in a matrix respectively corresponding to intersections of the plurality of video signal lines and the plurality of scanning signal lines, wherein a frame period, that is a period for displaying an image of one screen, is divided into one or more dark display periods when a relatively low luminance image is displayed and one or more bright display periods when a relatively high luminance image is displayed, each of the one or more bright display periods being set to be a period longer than one dark display period.

An eleventh aspect of the present invention is a displaying method according to the tenth aspect, which includes a display control step of outputting the video signal and a scanning-signal-line drive timing signal to drive the plurality of scanning signal lines, wherein in the display control step, the scanning-signal-line drive timing signal is outputted such that each two or more predetermined number of scanning signal lines among the plurality of scanning signal lines is driven at the same time during the dark display periods.

Advantages of the Invention

According to the first aspect of the present invention, one frame period, that is a period for displaying an image of one screen, includes one or more dark display periods when a relatively dark image is displayed and one or more bright display periods when a relatively bright image is displayed, and these one or more dark display periods and one or more bright display periods are repeated alternately. Therefore, a dark image is inserted when an image of one screen is rewritten. Thereby, human vision does not have an afterimage of a moving object and the motion blur is suppressed. Also, one bright display period is set to be a period longer than one dark display period. Therefore, a sufficient time is secured to charge a pixel capacitance of each pixel formation portion during the bright display period. Thereby, an insufficient charge-up during the bright display period that contributes greatly to an image that a human eye perceives is prevented and a sense of discomfort in human vision caused by a displayed image will be suppressed.

According to the second aspect of the present invention, a plurality of the scanning signal lines is driven at the same time during the dark display periods. Therefore, a period required to drive all the scanning signal lines becomes shorter than in a conventional configuration to drive scanning signal lines one by one. Thereby, one bright display period can be set to be a period longer than one dark display period.

According to the third aspect of the present invention, a plurality of scanning signal lines driven at the same time during the dark display periods is arranged consecutively. Therefore, a plurality of pixel formation portions included in a combined pixel formation portion group is arranged adjacently. If a luminance of a combined pixel formation portion group is determined based on luminances of the plurality of pixel formation portions included in the combined pixel formation portion group, an effect thereof to a displayed image is not significant since the plurality of the pixel formation portions is arranged adjacently. Thereby, the motion blur is efficiently suppressed, while image quality deterioration is prevented.

According to the fourth aspect of the present invention, a polarity of a video signal applied to each video signal line is set to be the same in all the periods when each scanning signal line is driven a plurality of times. Therefore, each pixel formation portion is efficiently charged also during the dark display periods.

According to the fifth aspect of the present invention, a luminance of a combined pixel formation portion group during the dark display periods are set to be an average value of luminances at a plurality of pixel formation portions included in the combined pixel formation portion group. Therefore, an effect thereof to a displayed image is insignificant and the motion blur is efficiently suppressed while image quality deterioration is prevented, as in the third aspect.

According to the sixth aspect of the present invention, when a gradation of a combined pixel formation portion group during the dark display period is calculated, an average value of luminances which are determined based on a gradation of each pixel formation portion included in the combined pixel formation portion group is calculated, and the gradation is calculated based on the average value. Therefore, although gradation and luminance have a non-linear relationship, a gradation for generating a video signal is calculated so as not to cause a sense of discomfort in human vision caused by a luminance of a displayed image.

According to the seventh aspect of the present invention, a predetermined compensation is performed in the calculation of a gradation of a combined pixel formation portion group during the dark display periods. Thereby, insufficient charge-up is prevented, even if a polarity of a video signal is inverted when each of the scanning signal lines is driven consecutively.

According to the eighth aspect of the present invention, a plurality of scanning signal lines is driven at the same time during the dark display periods. Also, a luminance of a combined pixel formation portion group during the dark display periods is set to be a luminance of a predetermined pixel formation portion in a plurality of pixel formation portions included in the combined pixel formation portion group. Therefore, an effect thereof to a displayed image is insignificant. Thereby, the motion blur is suppressed efficiently, while image quality deterioration is prevented.

According to the ninth aspect of the present invention, when an image of one screen is displayed, a relatively high luminance image is displayed after a relatively low luminance has been displayed. Therefore, a potential change of a video signal to be supplied to each video signal line is minimized, when a frame period is switched or when the dark display period is switched to the bright display period. Thereby, insufficient charge-up does not occur and the motion blur is efficiently suppressed.

According to the tenth aspect of the present invention, as in the first aspect, human vision does not have an afterimage of a moving object and the motion blur is suppressed. Also, insufficient charge-up during the bright display period, which contributes greatly to an image a human eye perceives, is prevented, and a sense of discomfort in human vision caused by a displayed image is suppressed.

DESCRIPTION OF THE REFERENCE SYMBOLS

Figure 1:
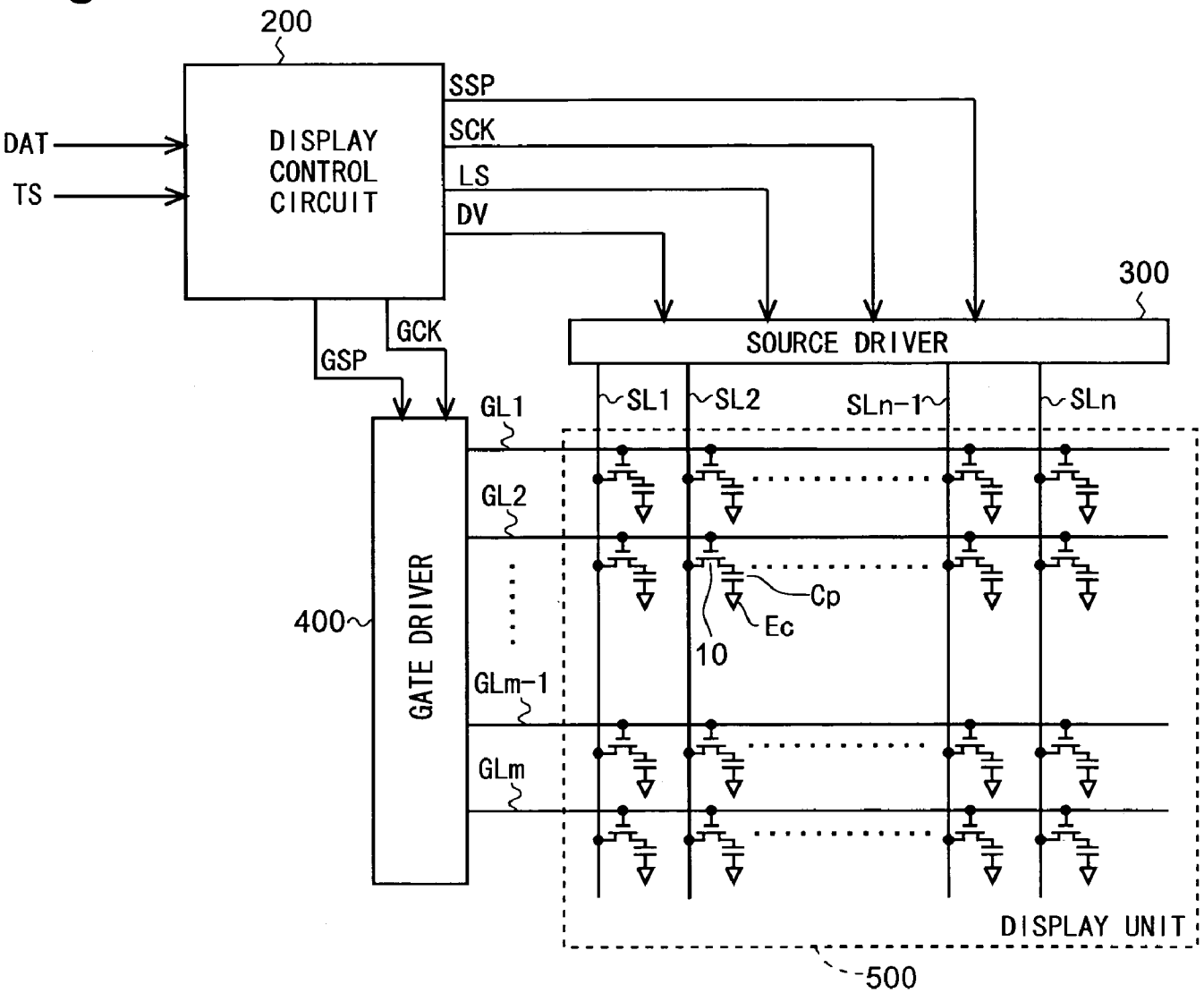
FIG. 1 is a block diagram showing a configuration of an active matrix type liquid crystal display device according to an embodiment of the present invention.

22: frame frequency conversion section
23: gradation generation section
24: dark-display-period gradation calculation section
25: gradation selection section
26: bright display LUT
27: dark display LUT
60: gamma conversion section
61: average value calculation section
62: gradation calculation section
63: reverse gamma conversion section
64: line memory
200: display control circuit
300: source driver
400: gate driver
500: display unit

BEST MODES FOR CARRYING OUT THE INVENTION

Hereinafter, an embodiment of the present invention will be described referring to the accompanying drawings.

1. Entire Configuration and Operation of a Liquid Crystal Display Device

FIG. 1 is a block diagram showing an entire configuration of an active matrix type liquid crystal display device according to a first embodiment of the present invention. This liquid crystal display device includes a display control circuit 200, a source driver (video signal line drive circuit) 300, a gate driver (scanning signal line drive circuit) 400, and a display unit 500. The display unit 500 includes a plurality of (n) video signal lines SL1 to SLn (hereinafter, also referred to as "the first column to the n-th column video signal lines"), a plurality of (m) scanning signal lines GL1 to GLm (hereinafter, also referred to as "the first row to the m-th row scanning signal lines), and a plurality of (n×m) pixel formation portions arranged respectively corresponding to intersections of the plurality of video signal lines SL1 to SLn and the plurality of scanning signal lines GL1 to GLm. Each pixel formation portion includes a TFT 10 that is a switching element, a gate terminal of which is connected to a scanning signal line passing through a corresponding intersection and a source terminal of which is connected to a video signal line passing through the intersection, a pixel electrode connected to a drain terminal of the TFT 10, and a liquid crystal layer that is commonly provided for the plurality of pixel formation portions and sandwiched between the pixel electrode and a common electrode Ec. Then, a capacitance formed by a pixel electrode and the common electrode Ec constitutes a pixel capacitance Cp. Also, each pixel formation portion corresponds to a pixel of a displayed image and a gradation or a luminance is determined pixel by pixel. Note that, hereinafter, a gradation determined for each pixel is also referred to as "gradation of a pixel formation portion" and a luminance determined for each pixel is also referred to as "luminance of a pixel formation portion."

The display control circuit 200 receives a data signal DAT and a timing control signal TS transmitted from outside, and outputs a digital video signal DV, and a source start pulse signal SSP, a source clock signal SCK, a latch strobe signal LS, a gate start pulse signal GSP, and a gate clock signal GCK, for controlling a timing to display an image on the display unit 500. Here, the gate start pulse signal GSP and the gate clock signal GCK form a scanning-signal-line drive timing signal.

The source driver 300 receives the digital video signal DV, the source start pulse signal SSP, the source clock signal SCK and the latch strobe signal LS, which have been outputted from the display control circuit 200, and applies a driving video signal to each of the video signal lines SL1 to SLn for charging a pixel capacitance of each pixel formation portion in the display unit 500. At this time, the source driver 300 holds sequentially the digital video signal DV which exhibits a voltage to be applied to each of the video signal lines SL1 to SLn at a timing when a pulse of the source clock signal SCK is generated. Then, the held digital video signal DV is converted to analog voltages which are applied to all the video signal lines SL1 to SLn as the driving video signals at the same timing when a pulse of the latch strobe signal LS is generated. That is, in the present embodiment, a line sequential driving method is employed for a driving method of the video signal lines SL1 to SLn. Here, regarding the source start pulse signal SSP and the source clock signal SCK, pulses are generated such that a voltage to be applied is provided to each of all the video signal lines SL1 to SLn within a period corresponding to one third of a conventional one horizontal scanning period, during a period corresponding to the first one third of each frame period, and such that a voltage to be applied is provided to each of all the video signal lines SL1 to SLn within a period corresponding to two thirds of the conventional one horizontal scanning period, during a period corresponding to the last two thirds of each frame period.

The gate driver 400 applies an active scanning signal to each of the scanning signal lines GL1 to GLm based on the gate start pulse signal GSP and the gate clock signal GCK, which have been outputted from the display control circuit 200. While details will be described hereinafter, in the present embodiment, a pulse of the gate start pulse signal GSP is generated two times with an interval of a period corresponding to one third of the conventional one horizontal scanning period, and further, a pulse of the gate start pulse signal GSP is generated again after a period corresponding to two thirds of one frame period has elapsed since the first one of the two pulses was generated. Also, regarding the gate clock signal GCK, pulses are generated with an interval of a period corresponding to one third of the conventional one horizontal scanning period during a period corresponding to the first one third of each frame period and pulses are generated with an interval of a period corresponding to two thirds of the conventional one horizontal scanning period during a period corresponding to the last two thirds of each frame period. By supplying a scanning signal to each of the scanning signal lines GL1 to GLm based on the gate start pulse signal GSP and the gate clock signal GCK as described above, one frame period is divided into two sub-frame periods. Conventionally, when one frame period is divided into two sub-frame periods as in the pseudo-impulse drive described hereinabove, one of the sub-frame periods is set to be a non-display period when an image is not displayed (a black image is inserted) and the other sub-frame period is set to be a display period when an image is displayed. On the other hand, in the present embodiment, one frame period is divided into a period when a relatively dark image is displayed (hereinafter, refereed to as "dark display period") and a period when a relatively bright image is displayed (hereinafter, referred to as "bright display period"). For details, a period corresponding to the first one third of each frame period is set to be the dark display period and a period corresponding to the last two thirds is set to be the bright display period. Also, by generating pulses of the gate start pulse signal GSP as described hereinabove, active scanning signals are applied to each two scanning signal lines during the dark display period. Note that, hereinafter, applying an active scanning signal to a scanning signal line is also referred to as "a scanning signal line is driven."

As described hereinabove, by applying a driving video signal to each of the video signal lines SL1 to SLn, and applying a scanning signal to each of the scanning signal lines GL1 to GLm, an image is displayed on the display unit 500.

Figure 2A:
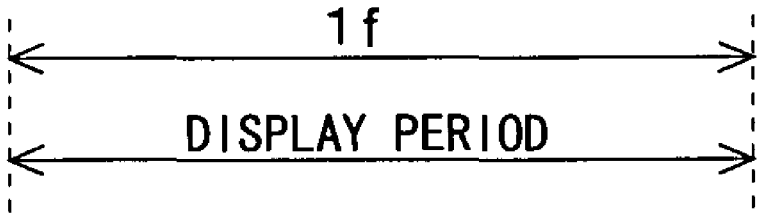
FIG. 2A is a diagram showing a display status of a conventional display device without a non-display period.
Figure 2B:
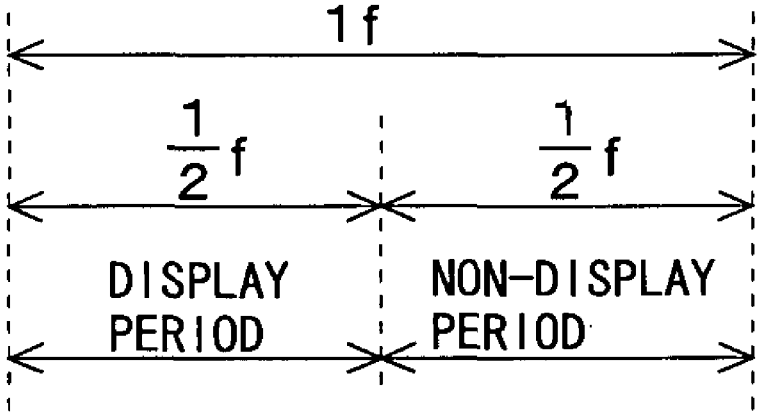
FIG. 2B is a diagram showing a display status of a conventional display device that employs a pseudo-impulse drive.
Figure 2C:
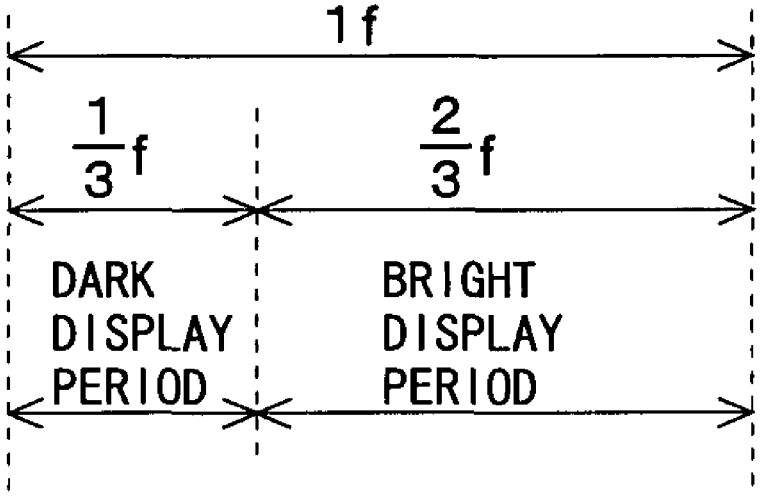
FIG. 2C is a diagram showing a display status in the embodiment.

Here, referring to FIG. 2, description will be provided for a difference between a display status of an image during one frame period in the present embodiment and a display status of an image during one frame period in a conventional display device. FIG. 2 is a diagram for explaining a display status of an image during one frame period (1f). FIG. 2A shows display status in a conventional display device without a non-display period. In this display device, an image is always displayed during one frame period. FIG. 2B shows a display status in a conventional display device employing a pseudo-impulse drive. In this display device, an image is displayed during the first one half of one frame period and the image is not displayed during the last half of one frame period. FIG. 2C shows a display status in the present embodiment. In the present embodiment, a relatively dark image is displayed during the first one third frame of one frame period and a relatively bright image is displayed during the last two thirds frame of one frame period.

2. Configuration and Operation of a Display Control Circuit

Figure 3:
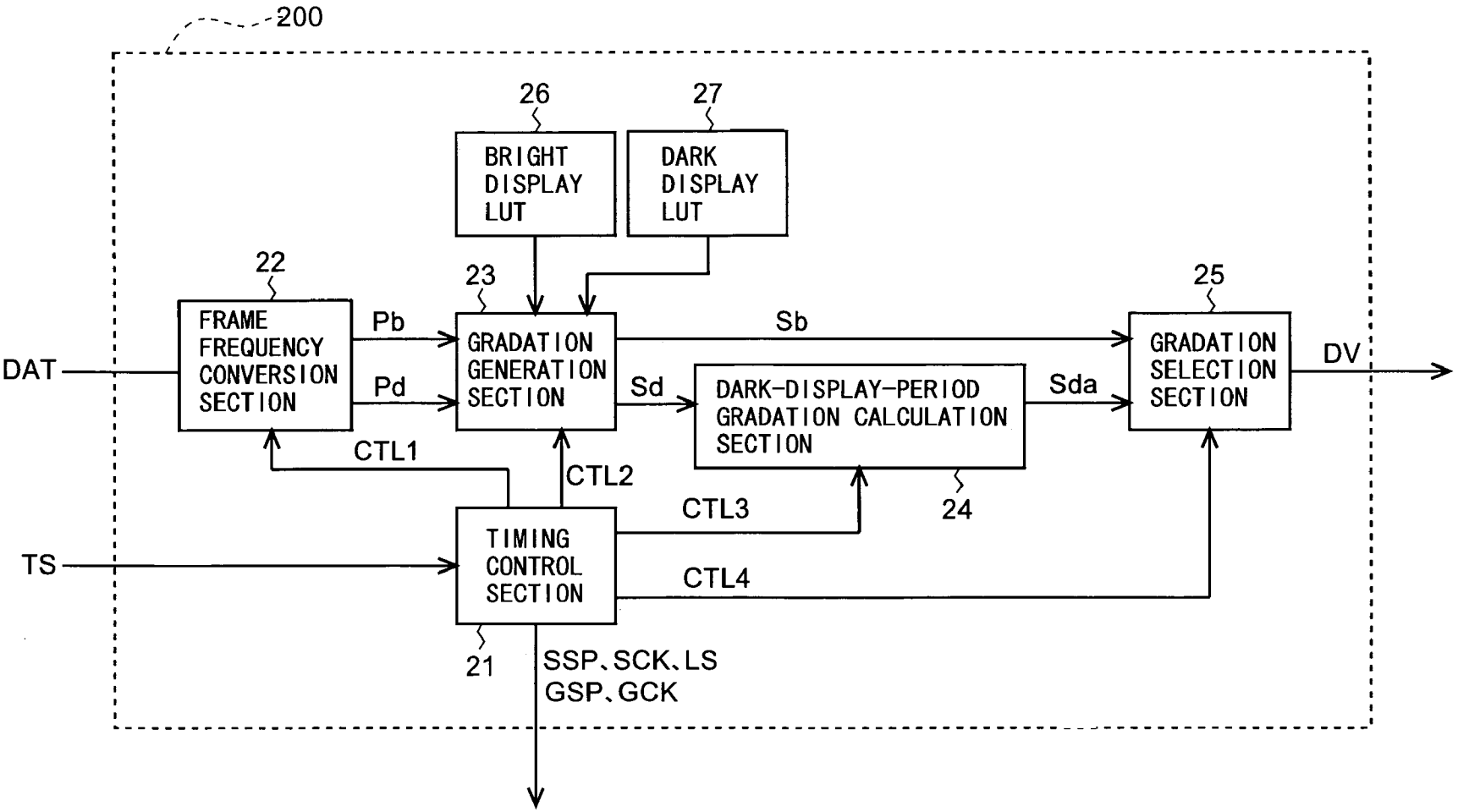
FIG. 3 is a block diagram showing a detailed configuration of a display control circuit in the embodiment.

FIG. 3 is a configuration diagram of the display control circuit 200 in the present embodiment. This display control circuit 200 includes a timing control section 21, a frame frequency conversion section 22, a gradation generation section 23, a dark-display-period gradation calculation section (dark-display-period gradation calculation circuit) 24, a gradation selection section 25, a bright display LUT 26, and a dark display LUT 27. Here, an LUT denotes a look up table that is referred to in a data conversion process and associates data before conversion and data after conversion with each other.

The timing control section 21 receives a timing control signal TS transmitted from outside and outputs a first control signal CTL1 for controlling operation of the frame frequency conversion section 22, a second control signal CTL2 for controlling operation of the gradation generation section 23, a third control signal CTL3 for controlling operation of the dark-display-period gradation calculation section 24, a fourth control signal CTL4 for controlling operation of the gradation selection section 25, and the source start pulse signal SSP, source clock signal SCK, the latch strobe signal LS, the gate start pulse signal GSP and the gate clock signal GCK for controlling a timing to display an image on the display unit 500.

The frame frequency conversion section 22 outputs, based on a data signal DAT transmitted from outside and the first control signal CTL1 outputted from the timing control section 21, a bright display data signal Pb with a frequency 1.5 times a frequency of the data signal DAT and a dark display data signal Pd with a frequency 3 times the frequency of the data signal DAT.

The gradation generation section 23 receives the bright display data signal Pb and the dark display data signal Pd outputted from the frequency conversion section 22 and the second control signal CTL2 outputted from the timing control section 21, and outputs a bright display gradation signal Sb and a dark display gradation signal Sd. For more details, the gradation generation section 23 converts the bright display data signal Pb into a signal representing a gradation of an image to be displayed during the bright display period, referring to the bright display LUT 26 where a gradation of an image based on the data signal DAT and a gradation of an image to be displayed during the bright display period are associated with each other, and outputs the signal after conversion as a bright display gradation signal Sb. Also, the gradation generation section 23 converts the dark display data signal Pd into a signal representing a gradation of an image to be displayed during the dark display period, referring to the dark display LUT 27 where a gradation of an image based on the data signal DAT and a gradation of an image to be displayed during the dark display period are associated with each other, and outputs the signal after conversion as a dark display gradation signal Sd. These conversions are performed based on the second control signal CTL2 outputted from the timing control section 21.

Figures 4A, 4B, 4C, 4D, 4E:
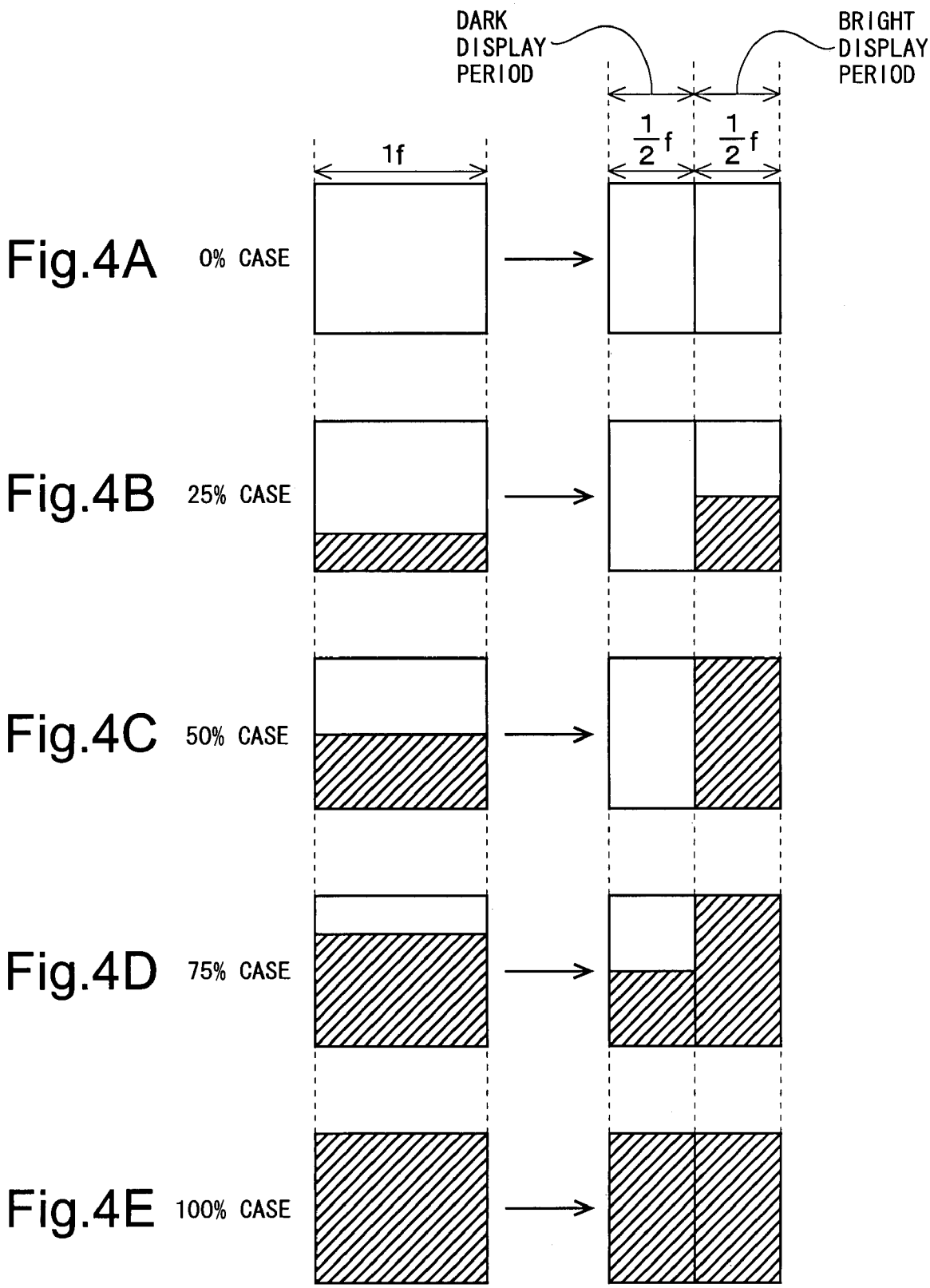
FIG. 4A is a diagram showing a dark display luminance and a bright display luminance in a case a luminance of an image based on a data signal DAT is 0%.
FIG. 4B is a diagram showing a dark display luminance and a bright display luminance in a case a luminance of an image based on the data signal DAT is 25%.
FIG. 4C is a diagram showing a dark display luminance and a bright display luminance in a case a luminance of an image based on the data signal DAT is 50%.
FIG. 4D is a diagram showing a dark display luminance and a bright display luminance in a case a luminance of an image based on the data signal DAT is 75%.
FIG. 4E is a diagram showing a dark display luminance and a bright display luminance in a case a luminance of an image based on the data signal DAT is 100%.

The bright display LUT 26 and the dark display LUT 27, described hereinabove, are prepared in the present embodiment such that an image of one screen with a luminance based on the data signal DAT is displayed during one frame period consisting of one bright display period and one dark display period. This will be described referring to FIG. 4. FIG. 4 is a diagram for explaining about conversion from a luminance of an image based on the data signal DAT inputted from outside to a luminance of an image to be displayed during the dark display period (hereinafter referred to as "dark display luminance) and to a luminance of an image to be displayed during the bright display period (hereinafter referred to as "bright display luminance"). In FIG. 4, a left column shows a luminance of an image based on the data signal DAT, and a right column shows a dark display luminance and a bright display luminance. Also, FIGS. 4A, 4B, 4C, 4D, and 4E show cases where luminances of images based on the data signal DAT are 0%, 25%, 50%, 75%, and 100%, respectively. Here, the minimum luminance of an image displayed on the display unit 500 is set to be 0% and the maximum luminance is set to be 100%.

First, calculation of a bright display luminance will be described. In a case where a luminance of an image based on the data signal DAT, Bdat, is equal to or lower than 50%, a bright display luminance Bb is calculated by the following equation (1).

$$Bb=Bdat\times 2 \quad (1)$$

Thereby, a luminance of an image based on the data signal DAT is converted into a bright display luminance, as shown in FIGS. 4A, 4B, and 4C.

On the other hand, in a case where a luminance of an image based on the data signal DAT, Bdat, is higher than 50%, a bright display luminance Bb is set to be 100%. Thereby, a luminance of an image based on the data signal DAT is converted into a bright display luminance, as shown in FIGS. 4D and 4E.

Next, calculation of a dark display luminance will be described. In the case where a luminance of an image based on the data signal DAT, Bdat, is equal to or lower than 50%, a dark display luminance Bd is set to be 0%. Thereby, a luminance of an image based on the data signal DAT is converted into a dark display luminance, as shown in FIGS. 4A, 4B, and 4C.

On the other hand, in the case where a luminance of an image based on the data signal DAT, Bdat, is higher than 50%, a dark display luminance Bd is calculated by the following equation (2).

$$Bd=Bdat\times 2-100 \quad (2)$$

Thereby, a luminance of an image based on the data signal DAT is converted into a dark display luminance, as shown in FIGS. 4D and 4E.

The bright display LUT 26 and the dark display LUT 27 are prepared such that a luminance based on the data signal DAT is converted into a bright display luminance and a dark display luminance as described hereinabove. Then, by a conversion of a signal representing a gradation of an image based on these bright display LUT 26 and dark display LUT 27, a bright display luminance and a dark display luminance appear on the display unit 500 during a bright display period and the dark display period, respectively. Note that FIG. 4 and the numerical value examples are typical and symbolic examples for explaining the display principle. Not limited to 0% and 100%, the luminances may be set to express a sufficiently dark luminance and a sufficiently bright luminance, respectively, according to a practical requirement such as a more smooth gradation expression, and this modification will not damage the advantage of the present invention. For example, when a luminance of 50% is to be displayed, it may be allowed without any problem to consider that a bright display luminance and a dark display luminance are set to be 90% and 10%, respectively, and each of the luminances is varied appropriately around the value.

The dark-display-period gradation calculation section 24 receives the dark display gradation signal Sd outputted from the gradation generation section 23 and the third control signal CTL3 outputted from the timing control section 21, outputs a dark display average gradation signal Sda that represents a gradation to be determined commonly for a plurality of pixel formation portions arranged corresponding to intersections of two scanning signal lines neighboring each other and video signal lines. Note that a detailed configuration or operation of the dark-display-period gradation calculation section 24 will be described hereinbelow.

The gradation selection section 25 receives the bright display gradation signal Sb outputted from the gradation generation section 23, the dark display average gradation signal Sda outputted from the dark-display-period gradation calculation section 24, and the fourth control signal CTL4 outputted from the timing control section 21, and outputs the digital video signal DV that represents a gradation of a voltage to be applied to each of the video signal lines SL1 to SLn. For further details, the gradation selection section 25 selects either of the bright display gradation signal Sb or the dark display average gradation signal Sda based on the fourth control signal CTL4, and outputs the selected signal as the digital video signal DV. Here, the fourth control signal CTL4 shows a timing when the bright display period and the dark display period are switched. Thereby, the bright display gradation signal Sb is selected during the bright display period and the dark display average gradation signal Sda is selected during the dark display period by the gradation selection section 25.

3. Video Signal Generation during the Dark Display Period

As described hereinabove, in the present embodiment, one frame period is divided into the dark display period and the bright display period. The dark display gradation signal Sd that represents a gradation of an image to be displayed during the dark display period is converted into the dark display average gradation signal Sda by the dark-display-period gradation calculation section 24 as described hereinabove and the conversion will be described in detail referring to FIG. 5.

Figure 5:
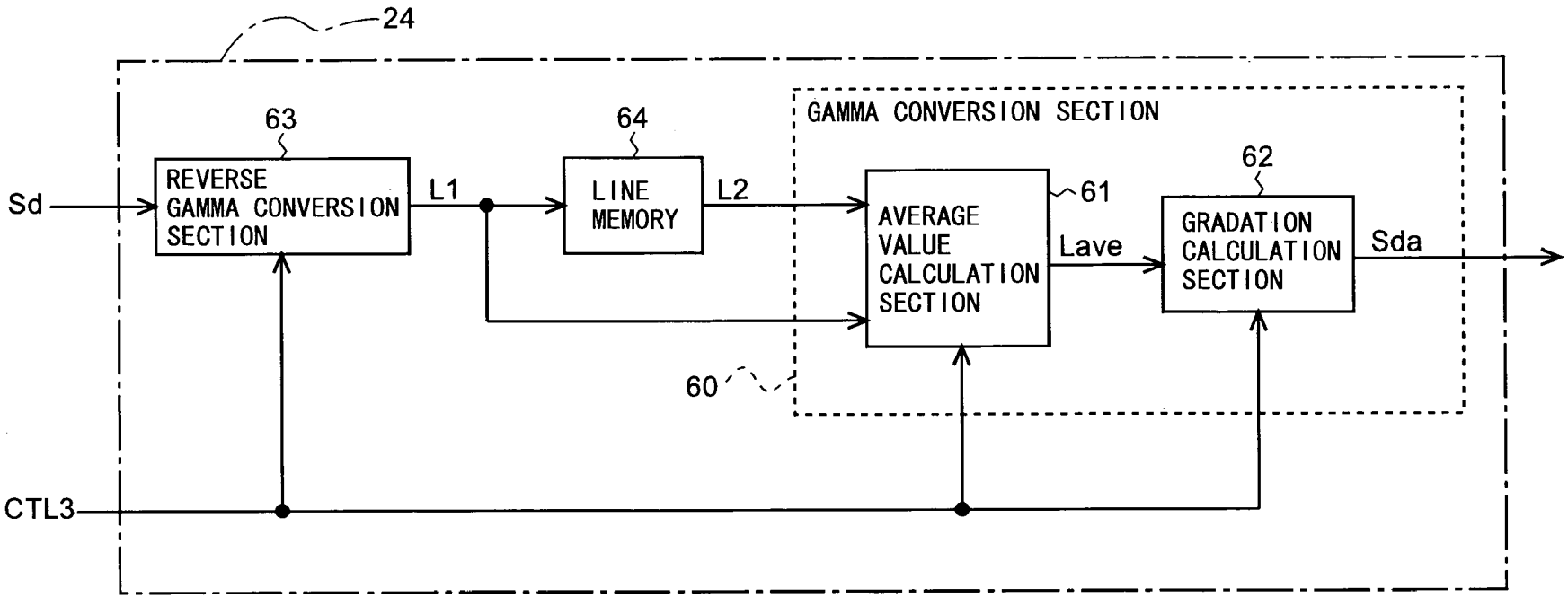
FIG. 5 is a block diagram showing a detailed configuration of a dark-display-period gradation calculation section in the embodiment.

FIG. 5 is a block diagram showing a detailed configuration of the dark-display-period gradation calculation section 24 in the present embodiment. The dark-display-period gradation calculation section 24 includes a reverse gamma conversion section 63, a line memory 64, and a gamma conversion section 60. The gamma conversion section 60 includes an average value calculation section 61 and a gradation calculation section 62.

The dark display gradation signal Sd and the third control signal CTL3 are inputted to this dark-display-period gradation calculation section 24. The reverse gamma conversion section 63 provides a reverse gamma conversion to the dark display gradation signal Sd, based on the third control signal CTL3. Thereby, a value of a luminance (hereinafter referred to as "luminance value") corresponding to a gradation represented by the dark display gradation signal Sd, L1, is outputted from the reverse gamma conversion section 63. Note that the reverse gamma conversion may be performed based on a predetermined conversion formula or based on a LUT which is prepared in advance.

The luminance value L1 outputted from the reverse gamma conversion section 63 is provided to the line memory 64 as well as to the average value calculation section 61 within the gamma conversion section 60. The line memory 64 can hold the luminance value L1 of pixel formation portions by one scanning signal line. Also, the luminance value L1 held by the line memory 64 is taken out by the average value calculation section 61 in a first-in-first-out manner. Thereby, the luminance value L1 sequentially outputted from the reverse gamma conversion section 63 is taken out from the line memory 64 by the average value calculation section 61 with a delay just corresponding to one horizontal scanning period. Therefore, to the average value calculation section 61, are inputted the luminance value L1 outputted from the reverse gamma conversion section 63 and a luminance value, that was outputted from the reverse gamma conversion section 63 one horizontal scanning period before and is taken out from the line memory 64, (hereinafter, referred to as "delayed luminance value"), L2.

The average value calculation section 61 receives the luminance value L1 and the delayed luminance value L2 and outputs an average value thereof (hereinafter, referred to as "average luminance value") Lave based on the third control signal CTL3. The gradation calculation section 62 receives the average luminance value Lave outputted from the average value calculation section 61 and provides a gamma conversion to the average luminance value Lave based on the third control signal CTL3. Thereby, a gradation corresponding to the average luminance value Lave is calculated, and a signal which represents the gradation is outputted as the dark display average gradation signal Sda from the gradation calculation section 62. Note that this gamma conversion may be performed based on a predetermined conversion formula or based on a LUT which is prepared in advance, as in the reverse gamma conversion described hereinabove.

Figure 6:
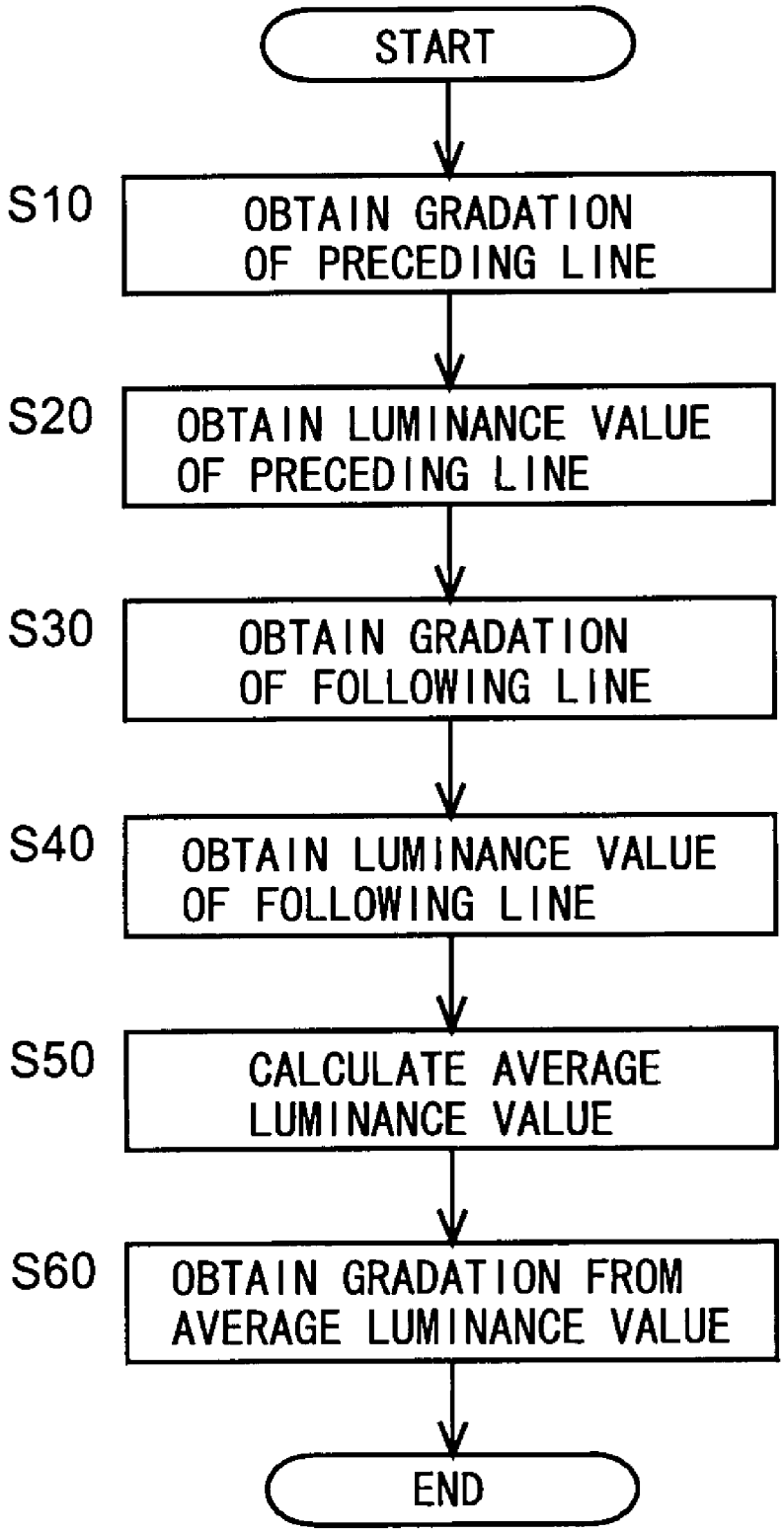
FIG. 6 is a flow diagram showing steps for calculating a gradation to generate a video signal during the dark display period in the embodiment.

Next, operation of the dark-display-period gradation calculation section 24 will be described in further detail referring to FIG. 6. FIG. 6 is a flowchart showing steps for calculating a gradation to generate a video signal during the dark display period in the present embodiment. Here, in the present description, out of two scanning signal lines driven at the same time during the dark display period, one scanning signal line driven first during each dark display period is called a preceding line and the other line is called a following line. Also, focusing on a certain video signal line, generation of a video signal to be supplied to the video signal line will be explained, and the video signal line is called an object video signal line. Further, two pixel formation portions arranged corresponding to intersections of two scanning signal lines driven at the same time during the dark display period and each video signal line are called a combined pixel formation portion group.

First, a gradation of a pixel formation portion arranged corresponding to an intersection of an object video signal line and a preceding line (hereinafter, referred to as "preceding line gradation") is obtained (step S10). Then, a reverse gamma conversion is provided to the preceding line gradation, and a luminance value of the pixel formation portion arranged corresponding to the intersection of the object video signal line and the preceding line (hereinafter, referred to as "preceding line luminance value") is obtained (step S20). Here, this preceding line luminance value corresponds to the delayed luminance value L2 described hereinabove.

Next, going to a step 30, a gradation of a pixel formation portion arranged corresponding to an intersection of the object video signal line and the following line (hereinafter, referred to as "following line gradation") is obtained. Then, a reverse gamma conversion is provided to the following line gradation, and a luminance value of the pixel formation portion arranged corresponding to the intersection of the object video signal line and the following line (hereinafter, referred to as "following line luminance value") is obtained (step S40). Here, this following line luminance value corresponds to the luminance value L1 described hereinabove.

Next, going to a step 50, an average luminance value is calculated by dividing a sum of the preceding line luminance value and the following line luminance value by two. In other words, a luminance averaged from the luminances originally to appear respectively at the two pixel formation portions included in a combined pixel formation portion group (average luminance value) is calculated. Then, a gamma conversion is provided to the average luminance value, and a gradation of a video signal to be supplied to the object video signal line is obtained (step S60).

Thus, gradations for generating video signals to be supplied to the video signal lines SL1 to SLn during the dark display period are calculated. Then a signal that represents the calculated gradations is outputted as the dark display average gradation signal Sda from the gradation calculation section 62, and the dark display average gradation signal Sda is outputted as the digital video signal DV from the gradation selection section 25. Further, gradations represented by the digital video signal DV are converted into analog voltages in the source driver 300 and the analog voltages are applied to the video signal lines SL1 to SLn as driving video signals. Thereby, a gradation of a combined pixel formation portion group becomes a gradation represented by the dark display average gradation signal Sda, and a luminance of the average luminance value described hereinabove appears at a portion corresponding to the combined pixel formation portion group in the display unit 500.

4. Driving Method

Figure 7:
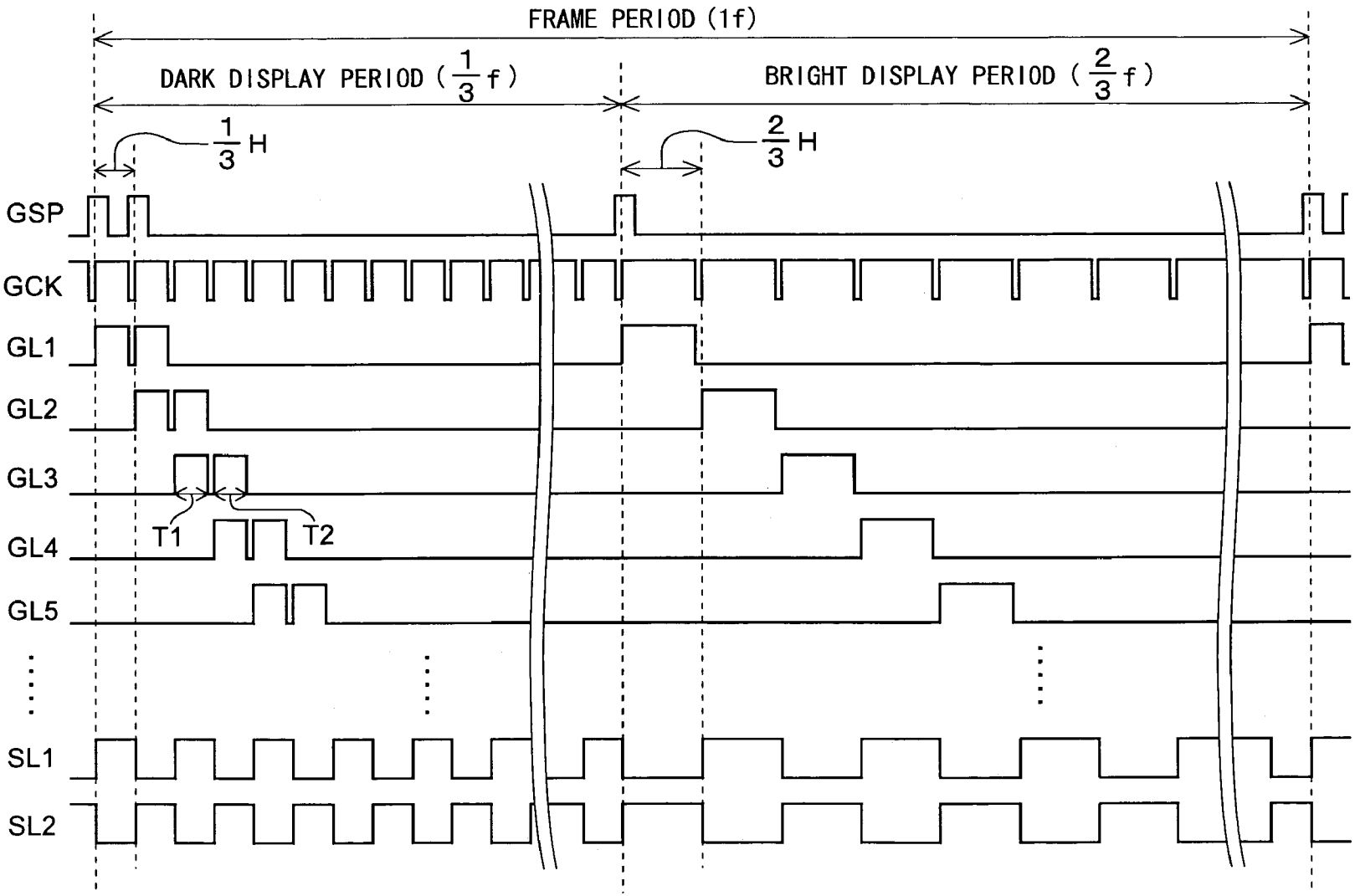
FIG. 7 is a signal waveform diagram in the embodiment.

Next, a driving method of the display device in the present embodiment will be described. FIG. 7 is a signal waveform diagram during one frame period in the present embodiment. As shown in FIG. 7, after a pulse of the gate start pulse signal GSP (hereinafter, this pulse is referred to as "the first pulse of the gate start pulse signal GSP") has been generated, by a pulse of the gate clock signal GCK generated first, a scanning signal supplied to the first row scanning signal line GL1 comes to exhibit a high level. Thereby, a frame period starts. A pulse width of the gate clock signal GCK corresponds to approximately one third of the conventional one horizontal scanning period, and during a whole period corresponding to the pulse width, the scanning signal supplied to the first row scanning signal line GL1 is held at the high level. After the pulse of the gate clock signal GCK has been generated, and in a period until a pulse of the gate clock signal GCK is generated next, a pulse of the gate start pulse signal GSP (hereinafter, this pulse is referred to as "the second pulse of the gate start pulse signal GSP") is generated again. Thereby, when a pulse of the gate clock signal GCK is generated next, a scanning signal supplied to the second row scanning signal line GL2 comes to exhibit a high level based on the first pulse of the gate start pulse signal GSP, and also, the scanning signal supplied to the first row scanning signal line GL1 comes to exhibit a high level based on the second pulse of the gate start pulse signal GSP. That is, the first row scanning signal line and the second row scanning signal line are driven at the same time. Since a pulse width of the gate clock signal GCK corresponds to approximately one third of the conventional one horizontal scanning period, here again, the scanning signals supplied to the first row scanning signal line GL1 and the second row scanning signal line GL2 are held at the high levels during a whole period corresponding to the pulse width. When a pulse of the gate clock signal GCK is generated next, a scanning signal supplied to the third row scanning signal line GL3 comes to exhibit a high level based on the first pulse of the gate start pulse signal GSP, and also the scanning signal supplied to the second row scanning signal line GL2 comes to exhibit a high level based on the second pulse of the gate start pulse signal GSP. That is, the second row scanning signal line and the third row scanning signal line are driven at the same time. Thus, in a period until a pulse of the gate start pulse signal GSP is generated next, two scanning signal lines neighboring each other are sequentially driven at the same time according to a pulse generation of the gate clock signal GCK. Also, focusing on each of the scanning signal lines GL1 to GLm, a scanning signal repeats two times to be held at a high level during a whole period corresponding to approximately one third of one horizontal scanning period. That is, a scanning signal supplied to each of the scanning signal lines GL1 to GLm exhibits a high level during a whole period totally corresponding to approximately two thirds of one horizontal scanning period.

After all the scanning signal lines GL1 to GLm have been driven in this manner, a pulse of the gate start pulse signal GSP (hereinafter, this pulse is called "the third pulse of the gate start pulse signal GSP") is generated again. Then, when a pulse of the gate clock signal GCK is generated first, the scanning signal supplied to the first row scanning signal line GL1 comes to exhibit a high level. That is, the first row scanning signal line is driven. Here, after the third pulse of the gate start pulse signal GSP has been generated, a pulse width of the gate clock signal GCK is set to be a period corresponding to approximately two thirds of the conventional one horizontal scanning period. Therefore, during a whole period corresponding to approximately two thirds of the conventional one horizontal scanning period, the scanning signal supplied to the first row scanning signal line GL1 is held at the high level. Then, when a pulse of the gate clock signal GCK is generated, the scanning signal supplied to the second row scanning signal line GL2 comes to exhibit a high level. That is, the second row scanning signal line is driven. Since a pulse width of the gate clock signal GCK corresponds, also here, to approximately two thirds of the conventional one horizontal scanning period, the scanning signal supplied to the second row scanning signal line GL2 is held at the high level during a whole period corresponding to the pulse width. Here, after the generation of the third pulse of this gate start pulse signal GSP, scanning signal lines are driven one by one.

After all the scanning signal lines GL1 to GLm have been driven in this manner, a pulse of the gate start pulse signal GSP and a pulse of the gate clock signal GCK are generated again, and the next frame period is switched on.

Thus, in the present embodiment, during a period corresponding to the first one third of each frame period, scanning signal lines are driven two by two at the same time such as, the first and the second scanning signal lines are driven at the same time, then the second and the third scanning signal lines are driven at the same time, etc. Also, focusing on each scanning signal line, the scanning signal line is driven two times each during a period corresponding to one third of the conventional one horizontal scanning period, within a period corresponding to two thirds of the conventional one horizontal scanning period.

Here, an explanation will be provided for video signals supplied to the video signal lines SL1 to SLn during a period when a certain scanning signal line is driven two times as described hereinabove. Here, referring to FIG. 7, an explanation will be made, focusing on the third row scanning signal line GL3 and the second column video signal line SL2. Note that a drive at the first time of the above described two time drives is called "the first drive," and a drive at the second time is called "the second drive." As shown in FIG. 7, regarding the third row scanning signal line, the first drive is done in a period indicated by a symbol T1 and the second drive is done in a period indicated by a symbol T2. Of these periods indicated by the symbols T1 and T2, the second drive of the second row scanning signal line is done in the period indicated by the symbol T1. On the other hand, in the period indicated by the symbol T2, the first drive of the fourth row scanning signal line is done. That is, in the period indicated by the symbol T1, the second scanning signal line and the third scanning signal line are driven at the same time, and in the period indicated by the symbol T2, the third scanning signal line and the fourth scanning signal line are driven at the same time.

The dark display gradation signal Sd that represents a gradation of an image to be displayed during the dark display period is converted into the dark display average gradation signal Sda by the dark-display-period gradation calculation section 24. At this time, an average luminance value is calculated based on the luminance value L1 and the delayed luminance value L2. These have been described hereinabove.

Here, regarding generation of a video signal supplied to the second column video signal line SL2 during the period indicated by the symbol T1, a luminance value originally to be appeared during the dark display period at a pixel formation portion arranged corresponding to an intersection of the second row scanning signal line. GL2 and the second column video signal line SL2 (corresponding to one pixel formation portion in a combined pixel formation portion group) corresponds to the above mentioned delayed luminance value L2, and a luminance value originally to be appeared during the dark display period at a pixel formation portion arranged corresponding to an intersection of the third row scanning signal line GL3 and the second column video signal line SL2 (corresponding to the other pixel formation portion in the combined pixel formation portion group) corresponds to the above mentioned luminance value L1. Therefore, in the period indicated by the symbol T1, a video signal is supplied to the second column video signal line SL2 such that a luminance of an average of the luminance, originally to be appeared at the pixel formation portion arranged corresponding to the intersection of the second row scanning signal line GL2 and the second column video signal line SL2, and the luminance, originally to be appeared at the pixel formation portion arranged corresponding to the intersection of the third row scanning signal line GL3 and the second column video signal line SL2, appears at a portion corresponding to these pixel formation portions (combined pixel formation portion group) in the display unit 500.

On the other hand, regarding generation of a video signal supplied to the second column video signal line SL2 during the period indicated by the symbol T2, a luminance value originally to be appeared during the dark display period at the pixel formation portion arranged corresponding to the intersection of the third row scanning signal line GL3 and the second column video signal line SL2 (corresponding to one pixel formation portion in a combined pixel formation potion group) corresponds to the above mentioned delayed luminance value L2, and a luminance value originally to be appeared during the dark display period at a pixel formation portion arranged corresponding to an intersection of the fourth row scanning signal line GL4 and the second column video signal line SL2 (corresponding to the other pixel formation portion in the combined pixel formation portion group) corresponds to the above mentioned luminance value L1. Therefore, in the period indicated by the symbol T2, a video signal is supplied to the second column video signal line SL2 such that a luminance of an average of the luminance, originally to be appeared at the pixel formation portion arranged corresponding to the intersection of the third row scanning signal line GL3 and the second column video signal line SL2, and the luminance, originally to be appeared at the pixel formation portion arranged corresponding to the intersection of the fourth row scanning signal line GL4 and the second column video signal line SL2, appears at a portion corresponding to these pixel formation portions (combined pixel formation portion group) in the display unit 500.

By supplying a video signal to each of the video signal lines SL1 to SLn as described hereinabove, at each pixel formation portion during the dark display period, a luminance of an average of the luminances, originally to be appeared during the dark display period at the pixel formation portion and a pixel formation portion arranged in one row above, appears during a whole period corresponding to one third of the conventional one horizontal scanning period, and then, a luminance of an average of the luminances, originally to be appeared during the dark display period at the pixel formation portion and at a pixel formation portion arranged in one row below, appears during a whole period corresponding to one third of the conventional one horizontal scanning period. Further, during the bright display period at each pixel formation portion, a luminance originally to be appeared at the pixel formation portion during the bright display period appears during a whole period corresponding to two thirds of the conventional one horizontal scanning period.

5. Effect of Video Signal Generation based on an Average Luminance Value

In the present embodiment, a video signal based on the above described average luminance value Lave is supplied to each of the video signal lines SL1 to SLn during the dark display period. Therefore, a luminance slightly different from a luminance of an image originally to be displayed during the dark display period appears on the display unit 500, but an effect thereof on image quality of a displayed image is insignificant and human vision is considered to have little sense of discomfort. The reason will be described in the following.

Figure 8:
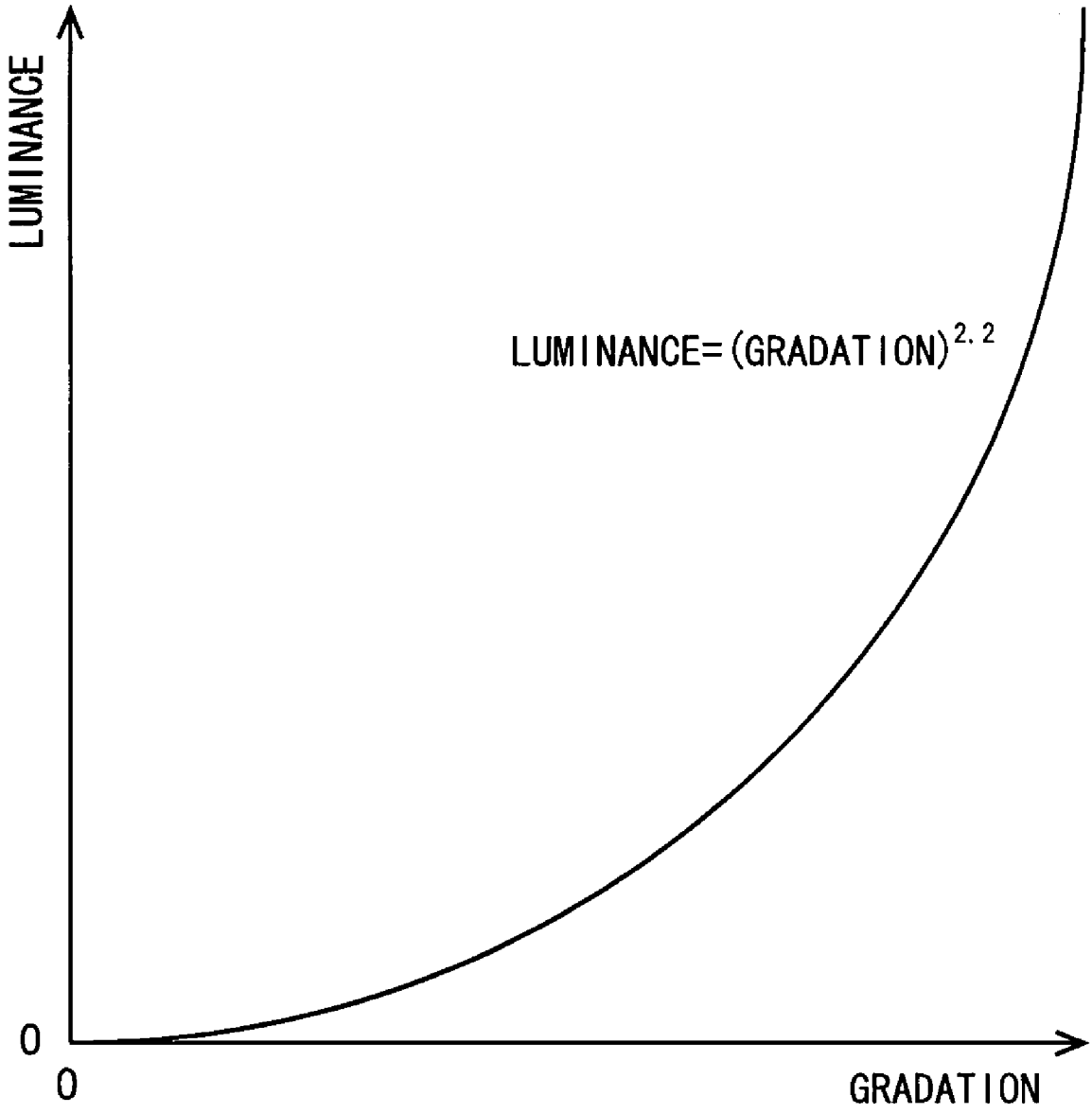
FIG. 8 is a graph showing a relationship of gradation and luminance.

When display of a dark image and display of a bright image are repeated as in the present embodiment, human vision will focus on the bright image rather than the dark image. Also, a luminance change during the bright display period provides a greater effect to human vision than a luminance change during the dark display period. Further, since gradation and luminance generally have a nonlinear relationship as shown in FIG. 8, a luminance change corresponding to a gradation variation becomes larger as brightness is increased. Thus, considering a contribution of an image during the dark display period and an image during the bright display period to an image that a human eye perceives, the contribution of an image during the dark display period is considered to be smaller.

Accordingly, the present embodiment employs a configuration where each two scanning signal lines is driven at the same time during the dark display period, and an luminance averaged from luminances of two pixel formation portions included in a combined pixel formation portion group is intended to appear at a portion corresponding to the combined pixel formation portion group in the display unit 500. By the way, when a dark image is displayed as a whole and a bright portion is included in a part of the image, the bright potion will be distinguished to cause a sense of discomfort in human vision. Therefore, it can be said that human vision requires higher preciseness (fineness) for a dark image. In the present embodiment, since a luminance of an image to be displayed during the dark display period frequently becomes 0% as described hereinabove when a dark image is displayed as a whole, appearing of a luminance averaged from luminances of two pixel formation portions on the display unit 500 is considered to provide little effect on a displayed image. On the other hand, when a bright image is displayed as a whole, a luminance of an image to be displayed during the bright display period frequently becomes 100% as described hereinabove. In this case, a luminance of an image of one screen is determined based on a luminance of an image displayed during the dark display period, but appearing of a luminance averaged from luminances of two pixel formation potions during the dark display period on the display unit 500 does not cause a sense of discomfort in human vision, since human vision requires lower preciseness for an bright image. Therefore, it is considered that appearing of a luminance different from a luminance originally to be appeared during the dark display period on the display unit 500 provides little sense of discomfort to human vision, regardless of a brightness of an image to be displayed.

Therefore, supplying a video signal based on the average luminance value Lave as described hereinabove to each of the video signal lines SL1 to SLn during the dark display period is considered to provide little effect on a displayed image and to cause little sense of discomfort in human vision.

6. Advantages

As described hereinabove, according to the present embodiment, one frame period, which is a period when an image of one screen is displayed, includes a dark display period when a relatively dark image is displayed and a bright display period when a relatively bright image is displayed, and these dark display period and bright display period are repeated alternately. Therefore a dark image is inserted when an image of one screen is rewritten. Thereby, human vision does not have an afterimage of a moving object and the motion blur is suppressed. Also, during the dark display period, each scanning signal line is driven consecutively two times each during a period corresponding to one third of the conventional one horizontal scanning period and also each two scanning signal lines is driven at the same time. Consequently, while each scanning signal line is driven during a period corresponding to two thirds of the conventional one horizontal scanning period in the dark display period, a length of the dark display period may be a period corresponding to one third of one frame period. Thereby, two thirds of one frame period can be allotted to the bright display period. As a result, a sufficient time is secured for charging a pixel capacitance of each pixel formation portion during the bright display period and deterioration of image quality caused by insufficient charge-up can be prevented.

7. Variation Example 1

Figure 9:
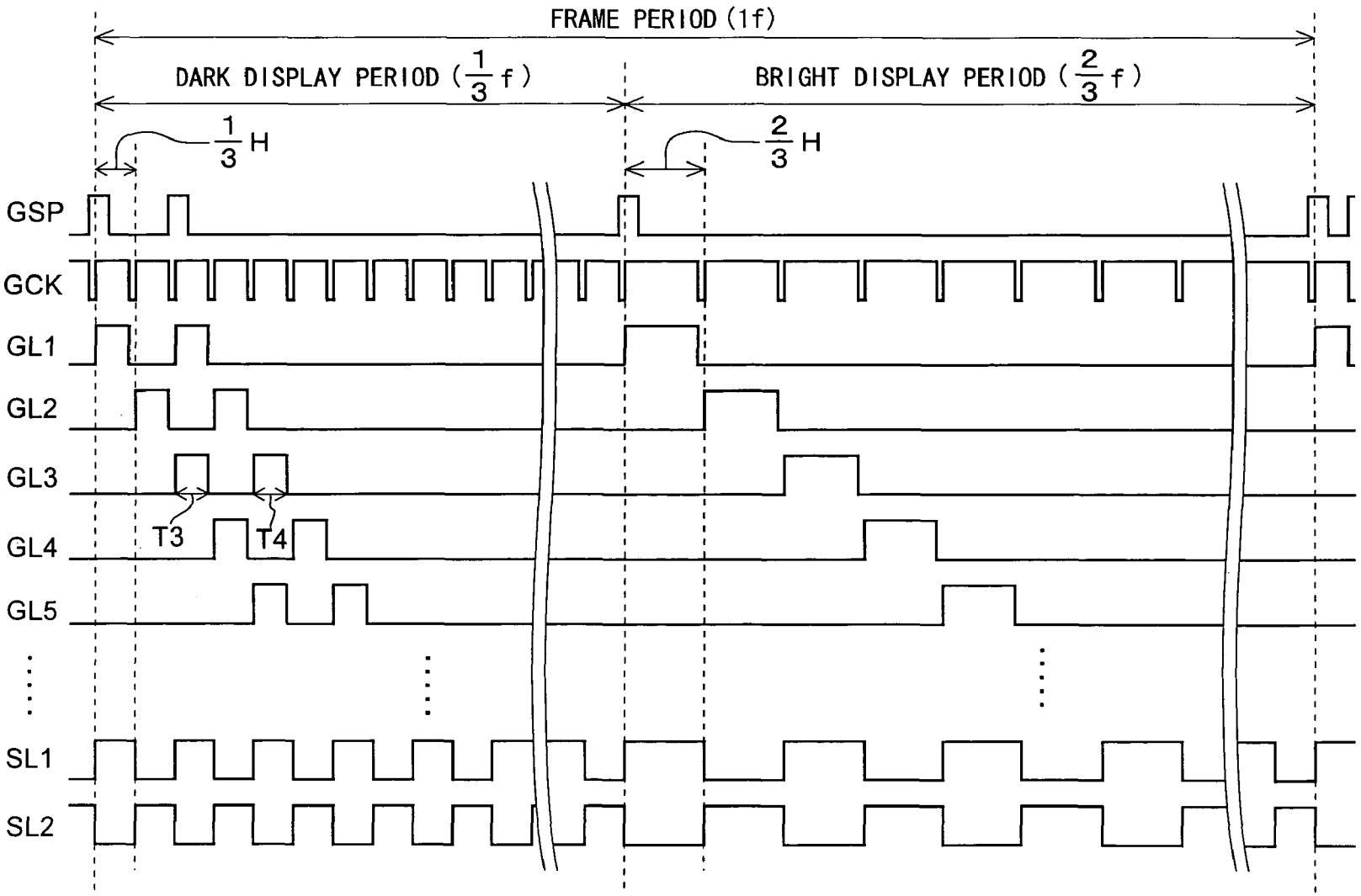
FIG. 9 is a signal waveform diagram in a first variation example of the embodiment.

Next, a variation example of the foregoing embodiment will be described. FIG. 9 is a signal waveform diagram in a first variation example of the foregoing embodiment. In this variation example, different from the foregoing embodiment shown in FIG. 7, among a plurality of scanning signal lines GL1 to GLm, two scanning signal lines sandwiching one scanning signal line are driven sequentially at the same time such as, "the first row GL1 and the third row GL3," "the second row GL2 and the fourth row GL4, the third row GL3 and the fifth row GL5," etc. Also, each scanning signal line is driven twice during the dark display period, and, after a drive at the first time (the first drive), a drive at the second time (the second drive) is done after a period corresponding to approximately one third of a conventional one horizontal scanning period has elapsed. Here, focusing on the third row scanning signal line GL3, the first drive is done in a period indicated by a symbol T3 and the second drive is done in a period indicated by a symbol T4. In these period indicated by the symbol T3 and period indicated by the symbol T4, a video signal applied to the first column video signal line SL1 has a plus polarity in the both periods and a video signal applied to the second column video signal line SL2 has a minus polarity for the both periods. Thus, a polarity of a video signal applied to each video signal line becomes the same during two periods when each scanning signal line is driven. This allows each pixel formation portion to be charged efficiently even in the dark display period.

8. Variation Example 2

Figure 10:
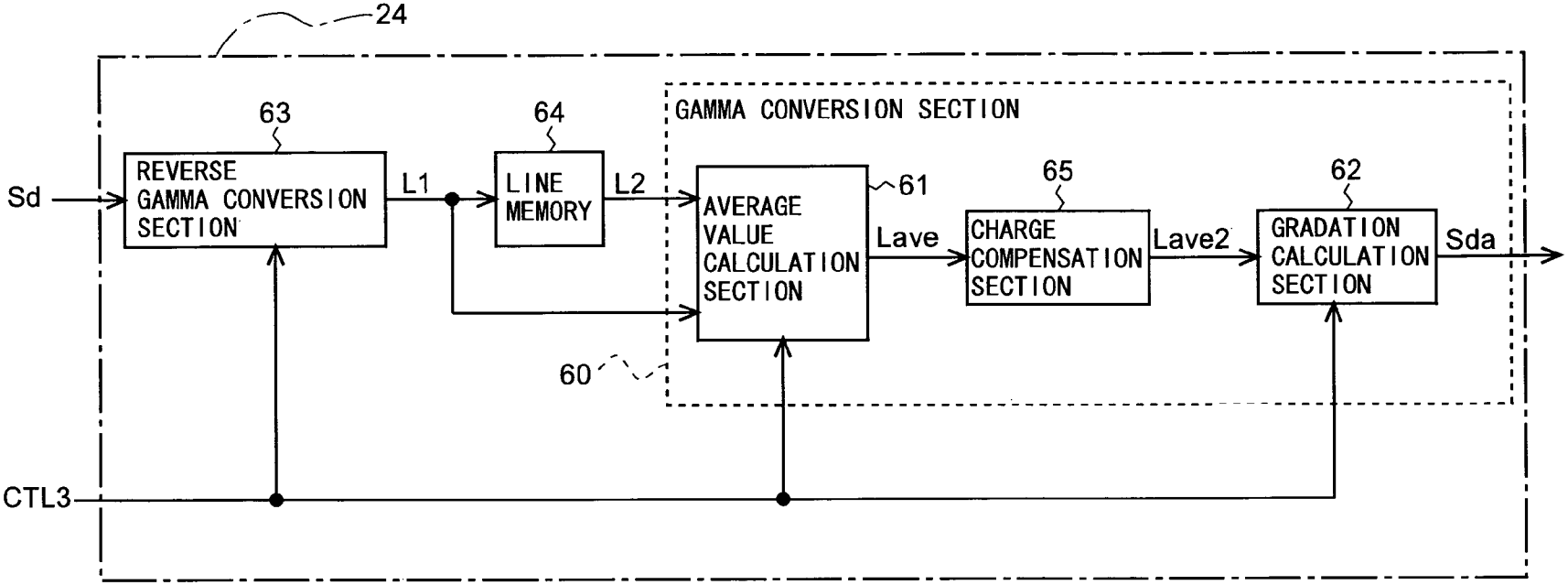
FIG. 10 is a block diagram showing a detailed configuration of a dark-display-period gradation calculation section in a second variation example of the embodiment.

Next, another variation example of the foregoing embodiment will be described. FIG. 10 is a block diagram showing a detailed configuration of a dark-display-period gradation calculation section 24 in a second variation example of the foregoing embodiment. As shown in FIG. 10, different from the foregoing embodiment, a charge compensation section 65 is included within a gamma conversion section 60. The charge compensation section 65 receives an average luminance value Lave outputted from an average value calculation section 61, and compensates the average luminance value Lave based on a predetermined conversion formula. Then, the charge compensation section 65 outputs the average luminance value Lave after compensation as a compensated average luminance value Lave2. A gradation calculation section 62 receives the compensated average luminance value Lave2 outputted from the charge compensation section 65, and provides a gamma conversion to the compensated average luminance value Lave2 based on the third control signal CTL3. Thereby, a gradation corresponding to the compensated average luminance value Lave2 is calculated and a signal representing the gradation is outputted from the gradation calculation section 62 as a dark display average gradation signal Sda.

As shown in FIG. 7, in the foregoing embodiment, a polarity of a video signal is inverted between a period when the first drive is done and a period when the second drive is done for each scanning signal line. Therefore, it may occur that a pixel capacitance is not sufficiently charged within a period corresponding to one third of the conventional one horizontal scanning period. According to the present variation example, however, the average luminance value Lave for calculating a gradation is compensated based on the predetermined conversion formula, and a gradation is calculated based on the compensated average luminance value Lave2 that is an average luminance value Lave after compensation. There, the conversion formula is set such that a pixel capacitance is charged in a shorter time. Thereby, a gradation voltage, so as to allow a pixel capacitance charge-up ratio to be higher than before the compensation, is applied to each of the video signal lines SL1 to SLn. Therefore, an insufficiency of a pixel capacitance charging rate caused by the inversion of the video signal polarity mentioned above is suppressed. As a result, a luminance appearing actually during the dark display period becomes close to a luminance originally to be appeared during the dark display period, and image quality deterioration of an image as a whole is prevented.

9. Others

In the foregoing embodiment, a case where one frame period consists of one bright display period and one dark display period is described as an example, but the present invention is not limited to this case. If an image dark enough not to cause an afterimage in human vision is inserted when a motion picture is displayed, the number of the bright display periods and the number of the dark display period within one frame period are not limited.

Figure 11A:
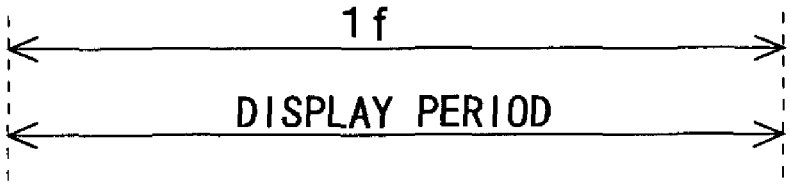
FIG. 11A is a diagram showing one display period.
Figure 11B:
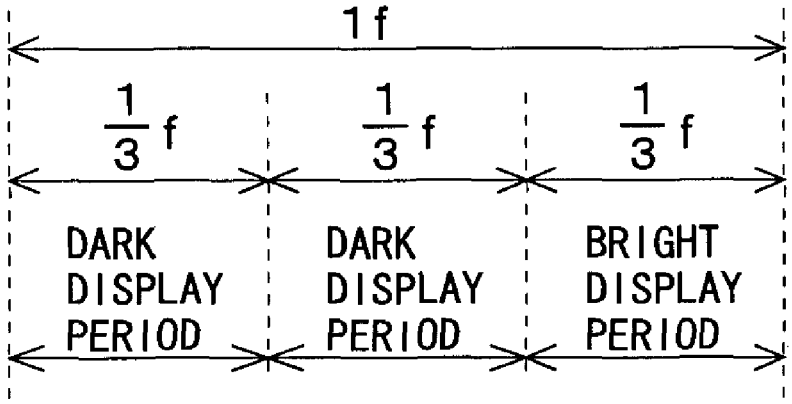
FIG. 11B is a diagram showing a display status of an image when each of two dark display periods and one bright display period is set to have the same length.
Figure 11C:
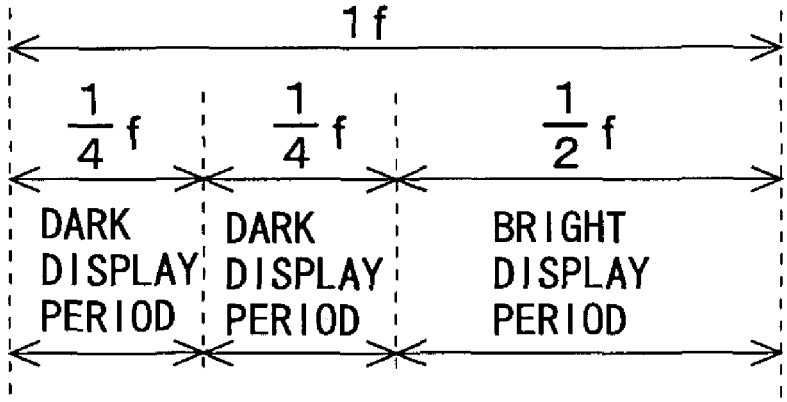
FIG. 11C is a diagram showing a display status of an image in a configuration where each two of scanning signal lines is driven at the same time during the dark display period.

FIG. 11 is a diagram explaining a display status of an image in a case where one frame period consists of two dark display periods and one bright display period. When a period of each of the two dark display periods and the one bright display period is set to have the same length, each period comes to have a length corresponding to one third of one frame period, as shown in FIG. 11B. However, when a configuration to drive each two scanning signal lines at the same time during the dark display period is employed as in the foregoing embodiment, one dark display period may have a length corresponding to one half of one bright display period, and one frame period is constituted as shown in FIG. 11C.

Figure 12A:
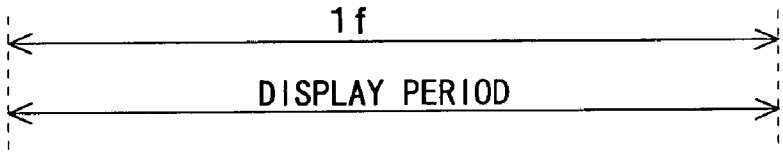
FIG. 12A is a diagram showing one display period.
Figure 12B:
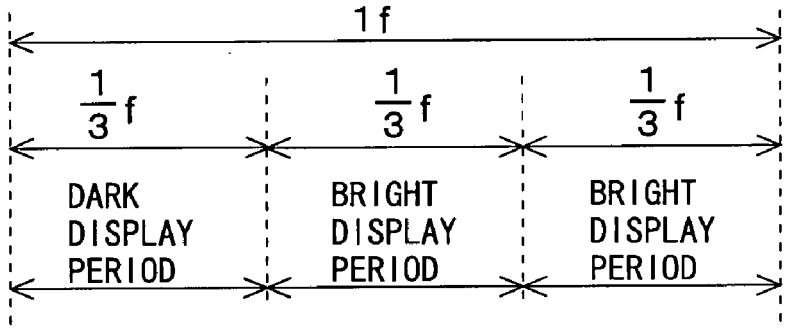
FIG. 12B is a diagram showing a display status of an image when each of one dark display period and two bright display periods is set to have the same length.
Figure 12C:
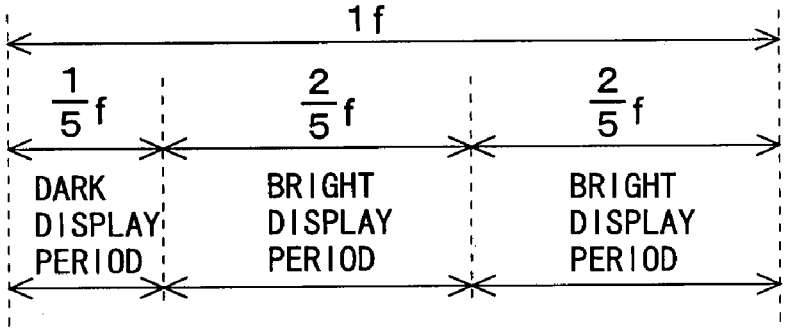
FIG. 12C is a diagram showing a display status of an image in a configuration where each two scanning signal lines is driven at the same time during the dark display period.

FIG. 12 a diagram for explaining a display status of an image in a case where one frame period consists of one dark display period and two bright display period. When a period of each of the one dark display period and the two bright display periods is set to be the same length, each period becomes a length corresponding to one third of one frame period, as shown in FIG. 12B. However, when a configuration to drive each two scanning signal lines at the same time during the dark display period is employed as in the foregoing embodiment, one dark display period may become a length corresponding to one half of one bright display period, and one frame period is constituted as shown in FIG. 12C.

Also in the foregoing embodiment, each two scanning signal lines is driven at the same time during the dark display period, but the present invention does not limit the number of the scanning signal lines to be driven at the same time to two lines. If luminance averaging does not cause significant deterioration of image quality, each three scanning signal lines may be driven at the same time according to a screen size or a dot size of a display device. For example, a usual TV signal has a vertical resolution of 480 lines, and when this picture is displayed on a display device compatible with the High-vision with a vertical resolution of 1,080 lines, two lines may be displayed together even if any deterioration of image quality is not allowed, since the picture has been already enlarged two times. In this case, only regarding the dark display luminance, even four lines are considered to be driven together with little effect on human vision.

Figure 13A:
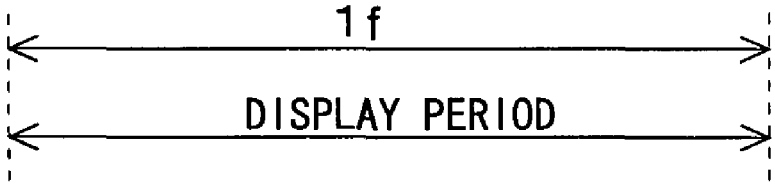
FIG. 13A is a diagram showing one display period.
Figure 13B:
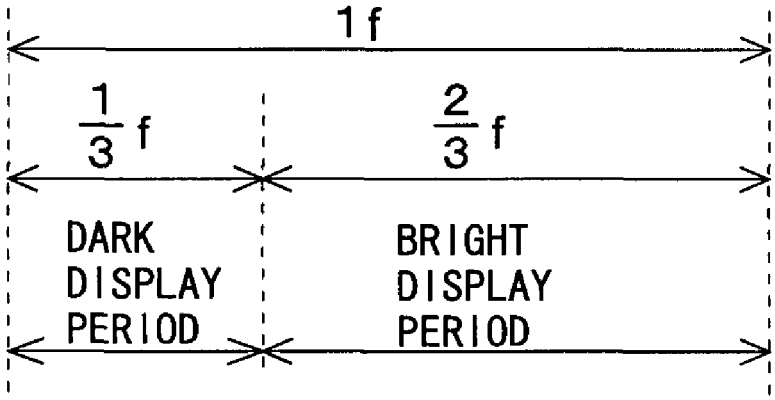
FIG. 13B is a diagram showing a display status of an image in a configuration where each two scanning signal lines is driven at the same time during the dark display period.
Figure 13C:
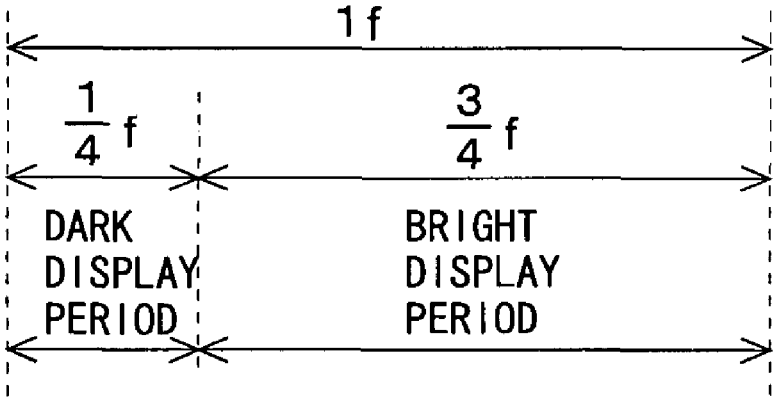
FIG. 13C is a diagram showing a display status of an image in a configuration where each three scanning signal lines is driven at the same time during the dark display period.
Figure 14:
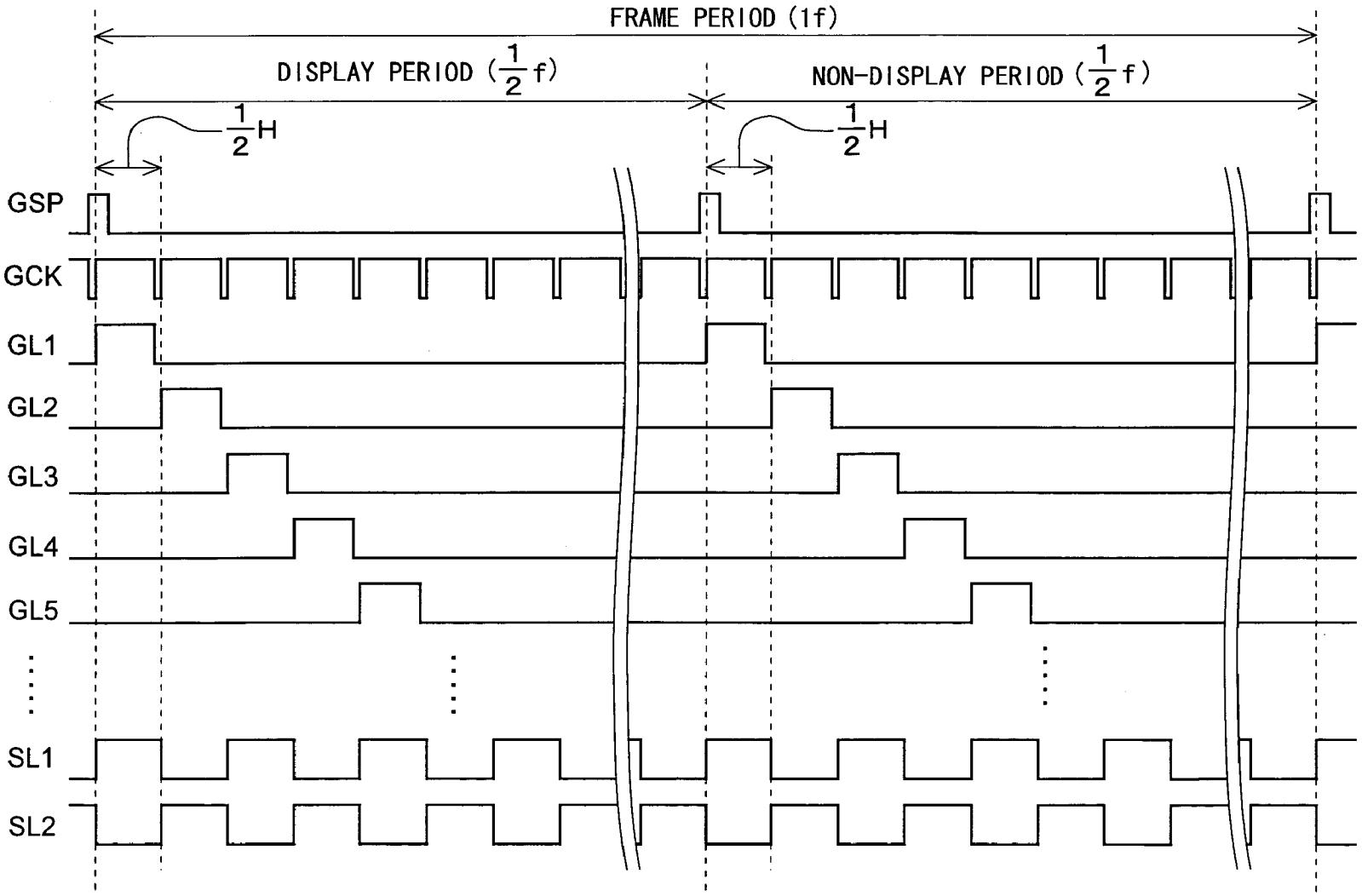
FIG. 14 is a signal waveform diagram in a conventional example.
Figure 15:
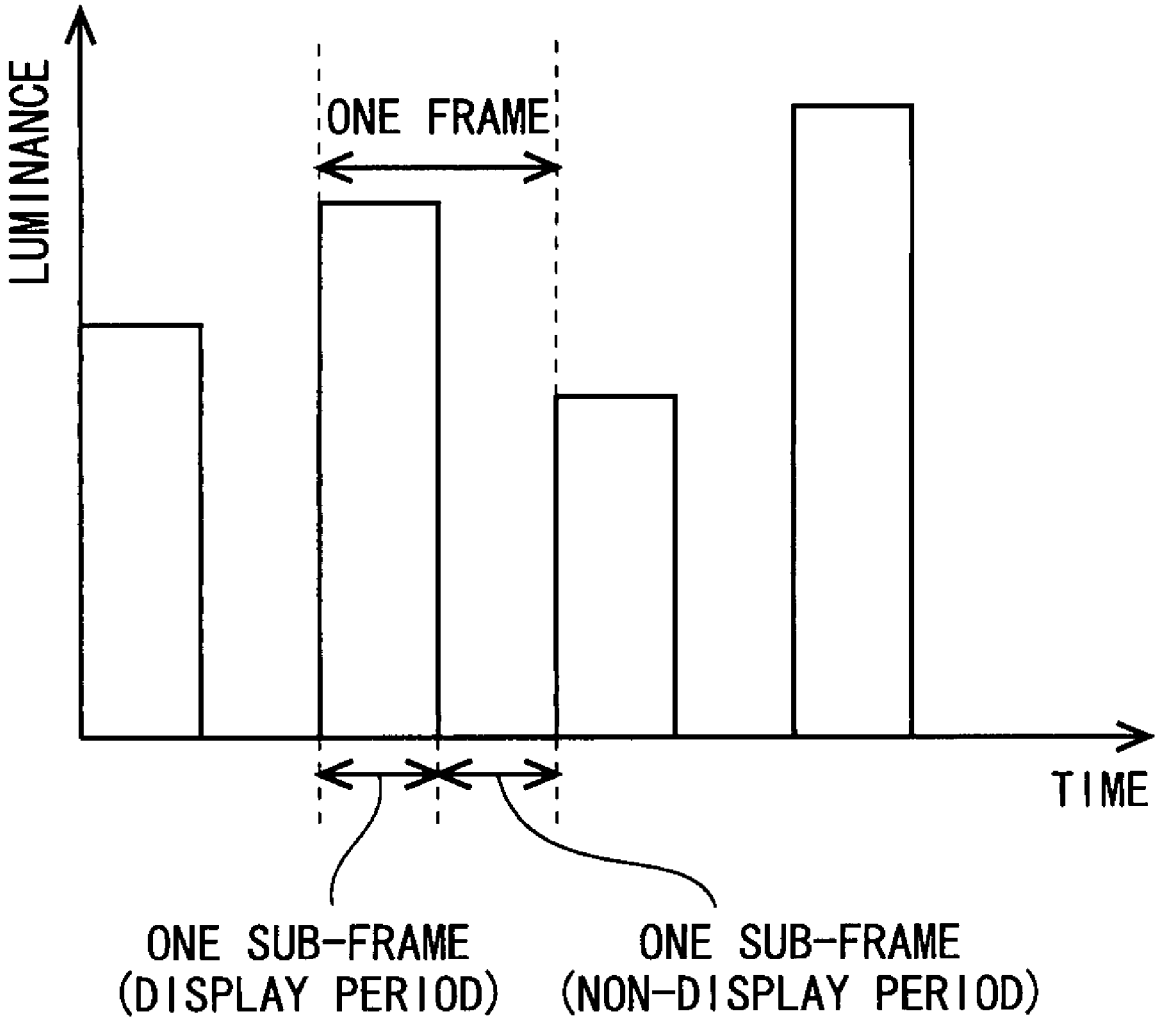
FIG. 15 is a diagram for explaining luminance variation in a conventional example.

FIG. 13 is a diagram for explaining a display status of an image in a case where a configuration to drive each three scanning signal lines at the same time during the dark display period is employed. Here, a configuration where one frame period consists of one dark display period and one bright display period is shown. When a configuration to drive each two scanning signal lines at the same time during the dark display period is employed, as shown in the foregoing embodiment, the dark display period comes to have a length corresponding to one half of a bright display period, as shown in FIG. 13B. However, when a configuration to drive each three scanning signal lines at the same time during the dark display period is employed, the dark display period may have a length corresponding to one third of the bright display period and one frame period is constituted as shown in FIG. 13C.

Further, in the foregoing embodiment, a drive is performed such that a luminance during the dark display period at two pixel formation portions included in a combined pixel formation portion group becomes a luminance averaged from luminances originally to be appeared at the two pixel formation portions, but the present invention is not limited to this case. The drive may be performed such that a luminance during the dark display period at two pixel formation portions included in a combined pixel formation portion group becomes a luminance at a pixel formation portion arranged corresponding to an intersection of a preceding line (scanning signal line driven first in each dark display period) in two scanning signal lines driven at the same time and each video signal line. Thereby, a luminance originally to be appeared appears at each pixel formation portion during a period after finishing charge-up during the dark display period and until starting charge-up during the bright display period. Therefore, the motion blur is suppressed, while deterioration of image quality is more efficiently prevented. Also, since an average luminance at pixel formation portions included in a combined pixel formation portion group needs not be calculated, a circuit therefor becomes unnecessary and a display device according to the present invention may be realized with a simpler configuration.

Further, considering an effect on display by a luminance error during the dark display period, even if an average gradation is used rather than an average luminance, an effect thereof on display is relatively small and calculation is simplified. In addition, rather than calculating an average gradation, it is also possible to use a gradation not higher than the other(s) in candidate gradations.

The invention claimed is:

1. A display device comprising:

a plurality of video signal lines configured to transmit a video signal based on an image to be displayed;

a plurality of scanning signal lines intersecting with the plurality of video signal lines;

a plurality of pixel formation portions arranged in a matrix respectively corresponding to intersections of the plurality of video signal lines and the plurality of scanning signal lines; and a display control circuit configured to outputs the video signal and a scanning-signal-line drive timing signal for driving the plurality of scanning signal lines;

wherein a frame period, which is a period for displaying an image of one screen, is divided into one or more dark display periods when a relatively low luminance image is displayed and one or more bright display periods when a relatively high luminance image is displayed, and the image of one screen is displayed using the one or more dark display periods and the one or more bright display periods by displaying with luminances determined based on a gradation of the image of one screen during each of the one or more dark display periods and the one or more bright display periods;

wherein one dark display period is set to be a period shorter than one bright display period;

wherein the display control circuit is configured to output the scanning-signal-line drive timing signal such that each two or more reference number of scanning signal lines of the plurality of scanning signal lines is driven at the same time during the dark display period; and wherein the display control circuit is configured to output the video signal such that, during a period when the two or more reference number of scanning signal lines are driven at the same time, a luminance of a combined pixel formation portion group, which is a plurality of pixel formation portions arranged corresponding to intersections of the two or more reference number of scanning signal lines and each of the video signal lines, becomes an average value of luminances to be displayed during the dark display period at a plurality ofpixel formation portions included in the combined pixel formation portion group and to be determined based on the gradation of the image of one screen.

2. The display device according to claim 1, wherein the display control circuit is configured such that the two or more reference number of scanning signal lines driven at the same time are a plurality of the scanning signal lines arranged consecutively in a direction where the plurality of video signal lines extend, and each scanning signal line is consecutively driven a plurality of limes during the dark display period.

3. The display device according to claim 1, wherein the display control circuit is configured such that the two or more reference number of scanning signal lines driven at the same time are a plurality of scanning signal lines alternately selected from among the plurality of scanning signal lines, each scanning signal line is driven a plurality of times during the dark display period, and the display control circuit is configured to outputs the scanning-signal-line drive timing signal and the video signal such that a polarity of a video signal applied to each video signal line becomes the same in all the periods when each scanning signal line is driven the plurality of times.

4. The display device according to claim 1, wherein the display control circuit includes a dark-display-period gradation calculation circuit configured to calculate a gradation of the combined pixel formation portion group during the dark display period, the dark-display-period gradation calculation circuit being configured to calculate an average value of luminances of a plurality of pixel formation portions included in the combined pixel formation portion group based on luminances to be displayed during the dark display period at each of the pixel formation portions and to be determined based on the gradation of the image of one screen; and to calculate the gradation of the combined pixel formation portion group during the dark display period based on the average value.

5. The display device according to claim 4, wherein the dark-display-period gradation calculation circuit further includes a charge compensation circuit configured to perform a compensation so as to increase a charging rate in each pixel formation portion when calculating the gradation of the combined pixel formation portion group during the dark display period.

6. The display device according to claim 1, wherein the one or more dark display periods precede in time the one or more bright display periods within the frame period.

7. A displaying method for a display device including a plurality of video signal lines for transmitting a video signal based on an image to be displayed; a plurality of scanning signal lines that intersects with the plurality of video signal lines; a plurality of pixel formation portions arranged in a matrix respectively corresponding to intersections of the plurality of video signal lines and the plurality of scanning signal lines; and a display control circuit that outputs the video signal and a scanning-signal-line drive timing signal for driving the plurality of scanning signal lines, the method comprising:

dividing a frame period, that is a period for displaying an image of one screen, into one or more dark display periods when a relatively low luminance image is displayed and one or more bright display periods when a relatively high luminance image is displayed, each of the one or more bright display periods being set to be a period longer than one dark display period; and outputting the scanning-signal-line drive liming signal from the display control circuit such that each two or more reference number of scanning signal lines of the plurality of scanning signal lines is driven at the same time during the dark display period;

wherein the display control circuit outputs the video signal such that, during a period when the two or more reference number of scanning signal lines are driven at the same time, a luminance of a combined pixel formation portion group, which is a plurality of pixel formation portions arranged corresponding to intersections of the two or more reference number of scanning signal lines and each of the video signal lines, becomes an average value of luminances to be displayed during the dark display period at a plurality of pixel formation portions included in the combined pixel formation portion group and to be determined based on the gradation of the image of one screen.

8. A display device comprising:

a plurality of video signal lines configured to transmit a video signal based on an image to be displayed;

a plurality of scanning signal lines intersecting with the plurality of video signal lines;

a plurality of pixel formation portions arranged in a matrix respectively corresponding to intersections of the plurality of video signal lines and the plurality of scanning signal lines; and a display control circuit configured to output the video signal and a scanning-signal-line drive timing signal for driving the plurality of scanning signal lines;

wherein a frame period, which is a period for displaying an image of one screen, is divided into one or more dark display periods when a relatively low luminance image is displayed and one or more bright display periods when a relatively high luminance image is displayed, and the image of one screen is displayed using the one or more dark display periods and the one or more bright display periods by displaying with luminances determined based on a gradation of the image of one screen during each of the one or more dark display periods and the one or more bright display periods;

wherein one dark display period is set to be a period shorter than one bright display period;

wherein the display control circuit is configured to output the scanning-signal-line drive timing signal such that each two or more reference number of scanning signal lines of the plurality of scanning signal lines is driven at the same time during the dark display period; and wherein the display control circuit is configured to output the video signal such that, during a period when the two or more reference number of scanning signal lines are driven at the same time, a luminance of a combined pixel formation portion group, which is a plurality of pixel formation portions arranged corresponding to intersections of the two or more reference number of scanning signal lines and each of the video signal lines, becomes a luminance to be displayed during the dark display period at a reference pixel formation portion among a plurality of pixel formation portions included in the combined pixel formation portion group and to be determined based on the gradation of the image of one screen.

* * * * *